US012649892B2

(12) United States Patent
Wheatley et al.

(10) Patent No.: US 12,649,892 B2
(45) Date of Patent: Jun. 9, 2026

(54) LUBRICATING COMPOSITIONS

(71) Applicant: TriboDyn, Inc., Mooresville, NC (US)

(72) Inventors: Mark Wheatley, Mooresville, NC (US); Erik Willett, Cuyahoga Falls, OH (US)

(73) Assignee: TRIBODYN, INC., Mooresville, NC (US)

( * ) Notice: Subject to any disclaimer, the term of this patent is extended or adjusted under 35 U.S.C. 154(b) by 0 days.

(21) Appl. No.: 19/018,391

(22) Filed: Jan. 13, 2025

(65) Prior Publication Data

US 2025/0145904 A1 May 8, 2025

Related U.S. Application Data

(63) Continuation-in-part of application No. 18/243,379, filed on Sep. 7, 2023, now Pat. No. 12,195,689.

(60) Provisional application No. 63/404,699, filed on Sep. 8, 2022.

(51) Int. Cl.

| | |
|---|---|
| ***C10M 169/04*** | (2006.01) |
| ***C10M 101/02*** | (2006.01) |
| ***C10M 125/18*** | (2006.01) |
| ***C10M 125/26*** | (2006.01) |
| ***C10M 135/18*** | (2006.01) |
| ***C10M 137/10*** | (2006.01) |
| ***C10M 141/10*** | (2006.01) |
| ***C10M 149/22*** | (2006.01) |
| ***C10M 161/00*** | (2006.01) |
| *C10N 30/02* | (2006.01) |
| *C10N 30/04* | (2006.01) |
| *C10N 30/06* | (2006.01) |
| *C10N 30/20* | (2006.01) |
| *C10N 40/04* | (2006.01) |
| *C10N 40/08* | (2006.01) |
| *C10N 40/25* | (2006.01) |

(52) U.S. Cl.

CPC ..... *C10M 169/044* (2013.01); *C10M 101/02* (2013.01); *C10M 125/18* (2013.01); *C10M 125/26* (2013.01); *C10M 135/18* (2013.01); *C10M 137/10* (2013.01); *C10M 141/10* (2013.01); *C10M 149/22* (2013.01); *C10M 161/00* (2013.01); *C10M 2201/081* (2013.01); *C10M 2201/087* (2013.01); *C10M 2203/1025* (2013.01); *C10M 2203/1065* (2013.01); *C10M 2217/046* (2013.01); *C10M 2219/068* (2013.01); *C10M 2223/045* (2013.01); *C10N 2030/02* (2013.01); *C10N 2030/04* (2013.01); *C10N 2030/06* (2013.01); *C10N 2030/20* (2013.01); *C10N 2040/04* (2013.01); *C10N 2040/08* (2013.01); *C10N 2040/25* (2013.01)

(58) Field of Classification Search

CPC ..... C10M 169/044; C10M 101/02; C10M 125/18; C10M 125/26; C10M 135/18; C10M 137/10; C10M 141/10; C10M 149/22; C10M 161/00; C10M 2201/081; C10M 2201/087; C10M 2203/1025; C10M 2203/1065; C10M 2217/046; C10M 2219/068

See application file for complete search history.

(56) References Cited

U.S. PATENT DOCUMENTS

| | | | | |
|---|---|---|---|---|
| 2,531,440 | A | 11/1950 | Jordan | |
| 7,598,210 | B2 * | 10/2009 | Olliges | C10M 169/04 508/155 |
| 9,206,377 | B1 * | 12/2015 | Warren | C10M 141/12 |
| 9,494,062 | B1 * | 11/2016 | Warren | C10M 125/26 |
| 10,273,428 | B1 * | 4/2019 | Warren | C10M 141/06 |
| 12,195,689 | B1 * | 1/2025 | Wheatley | C10M 125/18 |
| 2013/0005619 | A1 * | 1/2013 | Lee | C10M 125/00 508/136 |
| 2016/0289591 | A1 | 10/2016 | Fujiwara et al. | |
| 2016/0325994 | A1 * | 11/2016 | Qu | C10M 125/26 |

(Continued)

FOREIGN PATENT DOCUMENTS

EP 0767237 A1 4/1997

OTHER PUBLICATIONS

International Search Report and Written Opinion dated Dec. 12, 2025 for related International Application No. PCT/US2025/011402, filed Oct. 11, 2018 (18 pages).

*Primary Examiner* — Ellen M Mcavoy

(74) *Attorney, Agent, or Firm* — Daniel H. Lajiness; Nesbitt IP LLC

(57) ABSTRACT

A liquid composition for providing enhanced lubrication and wear protection, particularly under high-performance and/or extreme-pressure conditions. The composition comprises components that are solubilized, liquified, liquefacted, or sub-micronized, and are formulated to result in a stable, color-tunable composition that can be stored or implemented over extended periods of time without separation of solid components from the liquid. A composition can be a lubricant in which the solubilized, liquified, liquefacted, and/or sub-micronized components are comprised within a base oil, or an additive composition in which the components are formulated to be later added to a base oil. Suitable base oils are industrial, automotive, or open gear oils such as those used in the oil and gas industry, sugar mills, or in rock crushers; rock drill, pneumatic, and air tool oils; anti-seize compounds; cutting, gun, engine, air compressor, or bearing oils; slideway lubricants; and oven, kiln, foundry, metal-working, metalforming, or aerospace lubricants.

20 Claims, No Drawings

(56) References Cited

U.S. PATENT DOCUMENTS

2017/0369813 A1* 12/2017 Malshe ..... C10M 169/042
2021/0179427 A1* 6/2021 Devine ..... C10M 125/26

* cited by examiner

LUBRICATING COMPOSITIONS

CROSS-REFERENCE TO RELATED APPLICATION

The present application is a continuation-in-part of U.S. application Ser. No. 18/243,379 filed Sep. 7, 2023, which claims the benefit of U.S. Provisional Application No. 63/404,699 filed on Sep. 8, 2022, the disclosures of which are hereby incorporated by reference in their entireties.

FIELD OF THE INVENTION

This invention relates to the field of lubricant compositions that provide enhanced wear protection in extreme temperature and pressure conditions.

BACKGROUND OF THE INVENTION

Lubricant compositions are widely used in various commercial, industrial, and personal applications whenever two or more solid surfaces move in close contact, particularly in extreme temperature or performance conditions and/or where high performance is required. One such non-limiting example of high-performance conditions is in the running of a race car, which requires base oils that effectively operate at temperatures up to 2100° F. and extreme pressure. Examples of other equipment using such liquid compositions include, but are not limited to, gasoline engines, diesel engines, motors, turbines, gearboxes, bearings, hydraulic pumps, compressors, nail guns, lawn equipment, and electric saws. Lubricant compositions typically comprise multiple components solubilized, suspended, or mixed within a base oil. Non-limiting examples of such base oils are mineral oils, synthetic oils, and semi-synthetic oils. Synthetic oils are chemically synthesized and can contain polyalphaolefins, esters such as diesters, polyesters, polyolesters, alkylated naphthenes, alkylated benzenes, and/or hydrocracked/hydroisomerized mineral oils.

In one non-limiting example, a common application in which a lubricant composition is utilized is an automotive gear box, within which high-performance extreme pressure lubricants are often desired due to the significant amounts of wear in differential gear boxes. A thin film of oil and chemically deposited tribofilms occurs between the points of contact between every set of gears and enables power transmission without metal-metal contact that would destroy the gear box. Typically, an SAE 90 to 250 viscosity grade is recommended with an API GL-5 service category rated gear oil package or a higher tier SAE J2360 package for longer life applications. Multigrade gear oil with enhanced low temperature fluidity may also be desired. A typical SAE-90 monograde gear oil formulation can include 90.0% to 98.0% by weight of a heavy base oil, and 2.0% to 10.0% by weight of a gear oil performance package. A typical SAE 75W-90 multigrade gear oil formulation can also include 2.0% to 10.0% by weight of a gear oil performance package, in addition to 69.5% to 92.5% by weight of a light base oil, 5.0 to 20.0% by weight of a polymer-based viscosity modifier, and up to 0.5% by weight of a pour-point depressant. In both instances, the gear oil package is typically formulated to contain a balanced mixture of anti-wear, extreme pressure, and/or friction-modifying components, corrosion inhibitors, antioxidants, demulsifiers, and defoaming agents, in which the mixture is formulated to pass testing for automotive gear oil specifications such as API GL-4, API GL-5, AP MT-1, or SAE J2360.

Another non-limiting example of a common application in which a lubricant composition is utilized is in an engine. Engine oil formulations prioritize reducing wear which occurs between piston and cylinder, and on various components of the valve train and timing system. There is additional emphasis on reducing friction to allow more fuel energy to be converted into engine output rather than waste heat. Unlike gear oils, engine oils contain high levels of detergents and dispersants which control the formation of soot, varnish, and sludge over the lifetime of the oil. A typical passenger car engine oil formulation can include 72.5% to 86.9% by weight light base oil, 5.0% to 15.0% by weight of a viscosity modifier, 8.0% to 12.0% by weight of a detergent-inhibitor package, and up to 0.5% by weight of a pour-point depressant. A typical heavy duty diesel engine oil can contain the same components, while including 12.0% to 18.0% by weight of a detergent-inhibitor package and reducing the amount of the base oil. For both types of engine oil, the detergent-inhibitor package is typically formulated to contain a balanced mixture of anti-wear, detergent, dispersant, friction modifier, corrosion inhibition, antioxidant, demulsifier, and defoamer additives, in which the mixture has been proven to pass the testing for API, ILSAC, ATIEL, or ACEA specifications depending on the vehicle and region.

Another non-limiting example of a common application in which a lubricant composition is utilized is in a hydraulic pump. Hydraulic oils are intended to operate under mild to moderate extreme pressure conditions depending on the hydraulic pump design. A typical zinc-based hydraulic fluid is fairly simple due to the versatile nature of ZDDP additives with work provide many functions and work synergistically with most support additives. Hydraulic oil is primarily an anti-wear lubricant like engine oil but is generally operated at significantly lower temperatures and does not require the high usage of detergents and dispersants to control oxidation and combustion products. A typical hydraulic oil formulation can include 98.6% to 99.55% by weight of a light base oil, 0.25% to 0.50% by weight of zinc dithiodiphosphate (ZDDP), 0.10% to 0.50% by weight of an antioxidant, 0.05% to 0.20% by weight of a corrosion inhibitor, and 0.05% to 0.20% by weight of a defoamer.

High-performance anti-wear and extreme pressure lubricants typically rely on dispersed or temporarily mixed solid lubricant particles for their AW/EP performance. Solid lubricant additives typically include some combination of graphite, carbon black, molybdenum disulfide ($MoS_2$), tungsten disulfide ($WS_2$), powdered metals (copper), boron nitride, PTFE polymer, or proprietary insoluble organic or inorganic materials which have been micronized to typically 1-10 microns in diameter, though they may be smaller. To accommodate the use of solid lubricant additives, a dispersant strategy is required to prevent "fallout" of the solid particles upon storage before use or using downtime in equipment. There are several strategies to disperse large (1-10 micron) insoluble particles in oil, but in most cases these strategies only slow the inevitable separation of the components from the remaining composition and are not robust enough to withstand temperature fluctuations or dynamic storage conditions. As a result, traditional solid lubricant technology is best suited for fortifying greases, which are typically heterogeneous, opaque, and non-flowing materials that can contain the powders without allowing separation.

As a non-limiting example, U.S. Pat. No. 9,206,377, the disclosure of which is incorporated by reference in its entirety, describes a combination of solid molybdenum disulfide, solid boron nitride, and calcium fluoride powders, which under tribological conditions deposit a high-performance ceramic coating in situ at the site of wear. However, in practice, the solid boron nitride particles within the exemplary additive compositions of U.S. Pat. No. 9,206,377 demonstrate significant and rapid fallout due to their large particle size, both within the composition itself and once combined with a base oil. Unless such suspensions are frequently agitated or the machines and/or parts they lubricate are subjected to regular use, their components can separate into two or more layers, in which the solid components that provide the lubrication, particularly the boron nitride, are present in an opaque, "sludge-like" layer that can be difficult or impossible to reconstitute into the base oil. U.S. Patent Publication No. 2005/0119134, the disclosure of which is incorporated by reference in its entirety, describes unprocessed boron nitride comprising several layers of planar, hexagonal sheets having a generally smaller particle size (300 nm) than those described in U.S. Pat. No. 9,206,377. However, each of the exemplary compositions within U.S. Patent Pub. No. 2005/0119134 describe the use of "hexagonal boron nitrate solids," which too are prone to fallout.

Therefore, a further need remains to improve the reduce or eliminate the risk of fallout, improve product appearance, and reduce the complexity of dispersion systems for lubricating compositions that can provide low friction and high-performance anti-wear and extreme pressure protection.

SUMMARY OF THE INVENTION

The present invention provides compositions that provide enhanced lubricity and anti-wear properties under extreme pressure or high-performance conditions.

The lubricant compositions can be formulated with one or more, and preferably all, liquid-form components as precursors to forming a friction and wear reducing ceramic coating during operation. In some embodiments, one or more of liquid-form components can advantageously be substituted for solid lubricant compounds commonly found in similar lubricant compositions, which while having several benefits, are also known to cause issues associated with fallout, composition clarity, and overall appearance. In contrast, compositions of the present invention can be formed to have enhanced product stability with no fallout of solid additives, along with enhanced clarity to enable routine visual inspection and regular oil maintenance.

The present invention provides lubricant compositions that form a friction- and wear-reducing ceramic coating between two or more surfaces during operation in extreme temperature and pressure (ETP) use conditions, without the surfaces welding together. Such lubricant compositions can provide form a friction- and wear-reducing ceramic coating between two or more surfaces during operation under pressure loads of, as non-limiting examples, greater than or equal to about 100, 125, 150, 175, 200, 225, 250, 275, 300, 325, 350, 375, 400, 425, 450, 475, 500, 525, 550, 575, 600, 625, 650, 675, 700, 725, 750, 775, 800, 825, 850, 875, 900, 925, 950, 975, or 1,000 kilogram-force per square centimeter (kgf); and/or less than or equal to about 1,000, 975, 950, 925, 900, 875, 850, 825, 800, 775, 750, 725, 700, 675, 650, 625, 600, 575, 550, 525, 500, 475, 450, 425, 400, 375, 350, 325, 300, 275, 250, 225, 200, 175, 150, 125 kgf, or 100 kgf, without the surfaces welding together. In some embodiments, the lubricant compositions can provide form a friction- and wear-reducing ceramic coating between two or more surfaces during operation under a pressure load of any value greater than or equal to about 100 kgf, and less than or equal to about 1,000 kgf, without the surfaces welding together. In some embodiments, the lubricant compositions can provide form a friction- and wear-reducing ceramic coating between two or more surfaces during operation under a pressure load within any range between and inclusive of about 100 kgf and about 1000 kgf, without the surfaces welding together. Non-limiting examples of lubricant compositions formulated to operate under ETP conditions are industrial gear oils, automotive gear oils, metal-working and metal forming lubricants, open gear lubricants, mining oils, mill oils, and rock crusher oils.

According to the present invention, a lubricant composition can be formulated to provide anti-wear protection in less than ETP conditions. Such lubricant compositions can provide form a friction- and wear-reducing ceramic coating between two or more surfaces during operation under pressure loads of, as non-limiting examples, greater than or equal to about 1, 2.5, 5, 7.5, 10, 12.5, 15, 17.5, 20, 22.5, 25, 27.5, 30, 32.5, 35, 40, 42.5, 45, 47.5, 50, 52.5, 55, 57.5, 60, 62.5, 65, 67.5, 70, 72.5, 75, 77.5, 80, 82.5, 85, 87.5, 90, 92.5, 95, 97.5, or 100 kilogram-force per square centimeter (kgf); and/or less than or equal to about 100, 97.5, 95, 92.5, 90, 87.5, 85, 82.5, 80, 77.5, 75, 72.5, 70, 67.5, 65, 62.5, 60, 57.5, 55, 52.5, 50, 47.5, 45, 42.5, 40, 37.5, 35, 32.5, 30, 27.5, 25, 22.5, 20, 17.5, 15, 12.5, 10, 7.5, 5, or 2.5 kgf, down to 1 kgf, without the surfaces welding together. In some embodiments, the lubricant compositions can provide form a friction- and wear-reducing ceramic coating between two or more surfaces during operation under a pressure load of any value greater than or equal to about 1 kgf, and less than or equal to about 100 kgf, without the surfaces welding together. In some embodiments, the lubricant compositions can provide form a friction- and wear-reducing ceramic coating between two or more surfaces during operation under a pressure load within any range between and inclusive of about 1 kgf and about 100 kgf, without the surfaces welding together. In some embodiments, a lubricant composition of the present invention that can provide anti-wear protection anywhere within a range between and inclusive of about 1 kgf to about 100 kgf can also form a friction- and wear-reducing ceramic coating under ETP conditions. In one non-limiting example, the lubricant composition can be formulated to operate at pressure loads in a range greater than or equal to about 10 kgf, up to less than or equal to about 40 kgf, including any sub-range between and inclusive of 10 kgf and 40 kgf. Non-limiting examples of lubricant compositions formulated to operate under less than ETP conditions are engine oils, hydraulic oils, hydraulic fluids, way oils, and bearing oils.

According to the present invention, a lubricant composition can comprise a base oil and boron nitride. In any of the compositions described herein, the boron nitride can be sub-micronized. In some embodiments, sub-micronized boron nitride is prepared from the high-energy mechanical exfoliation of hexagonal boron nitride, wherein the sub-micronized boron nitride comprises nanoscale particles of boron nitride having average diameters less than or equal to about 100, 95, 90, 85, 80, 75, 70, 65, 60, 55, 50, 45, 40, 35, 30, 25, or 20 nm. In some embodiments, the sub-micronized boron nitride comprises particles having average diameters of any value between and inclusive of at least about 20 nm, and up to about 100 nm, including any sub-range between and inclusive of about 20 mm and about 100 nm. In some embodiments, at least 80, 85, 90, 92, 94, 95, 96, 97, 98, or 99% of the sub-micronized boron nitride particles have a diameter less than about 100, 95, 90, 85, 80, 75, 70, 65, 60, 55, 50, 45, 40, 35, 30, 25, or 20 nm. In some embodiments, all the sub-micronized boron nitride particles can have a diameter less than about 100, 95, 90, 85, 80, 75, 70, 65, 60, 55, 50, 45, 40, 35, 30, 25, or 20 nm. In some embodiments, the sub-micronized particles of boron nitride are combined and mixed within one or more synthetic or petroleum hydrocarbons and/or dispersants to form the sub-micronized boron nitride. In some embodiments, compositions of sub-micronized boron nitride are stable, homogeneous, and can be stored separately or within any of the compositions described herein with no visible fallout.

According to the present invention, a sub-micronized boron nitride can be further processed to a liquid or a liquid-like state via liquefaction. In a non-limiting example, raw or sub-micronized boron nitride particles can liquefacted via chemical exfoliation, such as by combining solid boron nitride with isopropyl alcohol or a mixture of aromatic hydrocarbons and esters. Without being limited by a particular theory, it is believed that liquefacting boron nitride disrupts van der Waals forces and other weak interactions between neighboring sheets and effectively solvates the exfoliated boron nitride within the liquid medium. Accordingly, and in various embodiments, compositions of the present invention comprising liquefacted boron nitride can be maintained without visible fallout or precipitation of boron nitride particles for up to 1 month, 3 months, 6 months, 9 months, 1 year, 2 years, or 5 years. In some embodiments, compositions of the present invention comprising liquefacted boron nitride can be maintained indefinitely without visible fallout or precipitation.

In some embodiments, any of the lubricant compositions described herein that comprise a base oil and boron nitride can comprise any concentration of boron nitride up to about 0.01, 0.05, 0.1, 0.2, 0.3, 0.4, 0.5, 0.6, 0.7, 0.8, 0.9, 1, 1.25, 1.5, 1.75, 2, 2.25, 2.5, 2.75, 3, 3.25, 3.5, 3.75, 4, 4.25, 4.5, 4.75, or 5% by weight of the composition. In some embodiments, the concentration of boron nitride can be any value between and inclusive of at least about 0.01% by weight and up to about 5% by weight, including any sub-range between and inclusive of about 0.01% by weight and about 5% by weight. Preferably, the concentration of boron nitride can be any value between and inclusive of at least about 0.1% by weight up to about 1% by weight of the composition, including any sub-range between and inclusive of about 0.1% by weight and about 1% by weight. Non-limiting examples of concentrations of boron nitride within a lubricant composition comprising a base oil and boron nitride are 0.01, 0.05, 0.1, 0.125, 0.2, 0.25, 0.3, 0.4, 0.5, 0.6, 0.7, 0.75, 0.8, 0.9, 1, 1.25, 1.5, 1.75, 2, 2.25, 2.5, 2.75, 3, 3.25, 3.5, 3.75, 4, 4.25, 4.5, 4.75, or 5% by weight.

According to the present invention, a lubricant composition can comprise graphite and/or a transition metal lubricant comprising compounds selected from the group consisting of tungsten disulfide, molybdenum disulfide, organic molybdenum, and any combination thereof. In various embodiments, the graphite, tungsten disulfide and/or molybdenum disulfide can be sub-micronized and/or liquefacted. In some embodiments, the lubricant composition comprises any concentration of the transition metal lubricant up to about 0.01, 0.05, 0.1, 0.2, 0.25, 0.3, 0.4, 0.5, 0.6, 0.7, 0.75, 0.8, 0.9, 1.0, 1.25, 1.5, 1.75, 2, 2.25, 2.5, 2.75, 3, 3.25, 3.5, 3.75, 4, 4.25, 4.5, 4.75, 5, 5.25, 5.5, 5.75, 6, 6.25, 6.5, 6.75, 7, 7.25, 7.5, 7.75, 8, 8.25, 8.5, 8.75, 9, 9.25, 9.5, 9.75, or 10% by weight of the composition. In some embodiments, the concentration of the transition metal lubricant can be any value between and inclusive of at least about 0.01% by weight and up to about 10% by weight, including any sub-range between and inclusive of about 0.01% by weight and about 10% by weight. Preferably, the concentration of the transition metal lubricant can be any value between and inclusive of at least about 0.25% by weight and up to about 6% by weight of the composition, including any sub-range between and inclusive of about 0.25% by weight and about 6% by weight. Non-limiting examples of concentrations of the transition metal lubricant are 0.01, 0.05, 0.1, 0.2, 0.25, 0.3, 0.4, 0.5, 0.6, 0.7, 0.75, 0.8, 0.9, 1.0, 1.25, 1.5, 1.75, 2, 2.25, 2.5, 2.75, 3, 3.25, 3.5, 3.75, 4, 4.25, 4.5, 4.75, 5, 5.25, 5.5, 5.75, 6, 6.25, 6.5, 6.75, 7, 7.25, 7.5, 7.75, 8, 8.25, 8.5, 8.75, 9, 9.25, 9.5, 9.75, or 10% by weight. In some embodiments, sub-micronized graphite, tungsten disulfide and/or molybdenum disulfide can be prepared by high-energy mechanical exfoliation. In some embodiments, the sub-micronized graphite, tungsten disulfide and/or molybdenum disulfide comprises nanoscale particles having average diameters less than or equal to about 100, 95, 90, 85, 80, 75, 70, 65, 60, 55, 50, 45, 40, 35, 30, 25, or 20 nm. In some embodiments, sub-micronized graphite, tungsten disulfide and/or molybdenum disulfide comprises particles having average diameters of any value between and inclusive of at least about 20 nm, and up to about 100 nm, including any sub-range between and inclusive of about 20 mm and about 100 nm. In some embodiments, at least 80, 85, 90, 92, 94, 95, 96, 97, 98, or 99% of the sub-micronized graphite, tungsten disulfide and/or molybdenum disulfide particles have a diameter less than about 100, 95, 90, 85, 80, 75, 70, 65, 60, 55, 50, 45, 40, 35, 30, 25, or 20 nm. In some embodiments, all of the sub-micronized graphite, tungsten disulfide and/or molybdenum disulfide particles can have a diameter less than about 100, 95, 90, 85, 80, 75, 70, 65, 60, 55, 50, 45, 40, 35, 30, 25, or 20 nm. In some embodiments, the sub-micronized particles of graphite, tungsten disulfide and/or molybdenum disulfide are combined and mixed within one or more synthetic or petroleum hydrocarbons and/or dispersants. In some embodiments, the sub-micronized graphite, tungsten disulfide and/or molybdenum disulfide is stable, homogeneous, and can be stored separately or comprised within any of the compositions described herein with no visible suspended or settled particles.

As described herein, "organic molybdenum" can be interchangeably referred to as a "liquid molybdenum complex". In some embodiments, the organic molybdenum is a liquid composition comprising molybdenum complexed with one or more oil-soluble organic species to form an oil-soluble molybdenum salt. In some embodiments, an oil-soluble molybdenum salt can be selected from the group consisting of molybdenum dialkyldithiophosphate (MoDDP), molybdenum dithiocarbamate (MoDTC), molybdenum amide, and combinations thereof. In a non-limiting example, the liquid molybdenum complex comprises MoDDP. In a non-limiting example, the liquid molybdenum complex comprises MoDTC. In a non-limiting example, the liquid molybdenum complex comprises molybdenum amide. In a non-limiting example, the liquid molybdenum complex comprises MoDDP and MoDTC. In a non-limiting example, the liquid molybdenum complex consists of MoDDP and/or MoDTC. In a non-limiting example, the composition can comprise any of the above liquid molybdenum complexes along with tungsten disulfide and/or molybdenum disulfide.

According to the present invention, a lubricant composition can comprise, or alternatively consist of, sub-micronized and/or liquefacted boron nitride, a transition metal lubricant, and a base oil. In some embodiments, a lubricant composition can consist of sub-micronized and/or liquefacted boron nitride, a transition metal lubricant, and a base oil. In some embodiments, the sub-micronized and/or liquefacted boron nitride and transition metal lubricant can be present within the composition in any of the concentrations or concentration ranges described above. In some embodiments, the lubricant composition can comprise: (a) any concentration or sub-range of concentrations of sub-micronized and/or liquefacted boron nitride including and up to about 5% by weight of the composition, and preferably any concentration or sub-range of concentrations of sub-micronized and/or liquefacted boron nitride between and inclusive of 0.1% by weight and 1% by weight of the composition; and (b) any concentration or sub-range of concentrations of a transition metal lubricant between and inclusive of about 0.01% by weight and about 10% by weight of the composition, including any concentration or sub-range of concentrations of a transition metal lubricant between and inclusive of about 0.25% by weight and about 6% by weight of the composition; wherein the balance is a base oil. In various embodiments, the transition metal lubricant comprises, or alternatively, consists of, organic molybdenum, comprising one or more organic molybdenum compounds selected from the group consisting of MoDDP, MoDTC, molybdenum amide, and any combination thereof.

In a non-limiting example, and in various embodiments, a lubricant composition of the present invention can comprise, or alternatively consist of: a base oil; from 0.1% by weight up to 10% by weight, and preferably from 0.25% by weight up to 6% by weight, of one or more transition metal lubricants, the transition metal lubricants selected from the group consisting of liquefacted tungsten disulfide, liquefacted molybdenum disulfide, and a liquid molybdenum complex, wherein the liquid molybdenum complex comprises an oil-soluble molybdenum salt selected from the group consisting of molybdenum alkyl dithiophosphate and molybdenum alkyl dithiocarbamate; and up to 5% by weight, and preferably from 0.1% by weight up to 1% by weight, of a sub-micronized boron nitride, the sub-micronized boron nitride comprising boron nitride particles having a particle size less than about 100 nm. In various embodiments, at least 50%, 55%, 60%, 65%, 70%, 75%, 80%, 85%, 90%, 95%, 97%, or 99% of the sub-micronized boron nitride particles have a particle size less than 100 nm. In various embodiments, the sub-micronized boron nitride particles consist of boron nitride particles having a particle size less than 100 nm.

In another non-limiting example, and in various embodiments, a lubricant composition can comprise, or alternatively consist of: a base oil; from about 0.25% by weight and up to about 6% by weight of a liquid molybdenum complex, wherein the liquid molybdenum complex comprises an oil-soluble molybdenum salt selected from the group consisting of molybdenum alkyl dithiophosphate and molybdenum alkyl dithiocarbamate; and up to about 5% by weight of a sub-micronized boron nitride, the sub-micronized boron nitride comprising boron nitride particles having a particle size less than about 100 nm. In various embodiments, at least 50%, 55%, 60%, 65%, 70%, 75%, 80%, 85%, 90%, 95%, 97%, or 99% of the sub-micronized boron nitride particles have a particle size less than 100 nm. In various embodiments, the sub-micronized boron nitride particles consist of boron nitride particles having a particle size less than 100 nm.

In another non-limiting example, and in various embodiments, a lubricant composition can comprise, or alternatively consist of: a base oil; from about 0.25% by weight and up to about 6% by weight of one or more transition metal lubricants, the transition metal lubricants selected from the group consisting of liquefacted tungsten disulfide, liquefacted molybdenum disulfide, and a liquid molybdenum complex, wherein the liquid molybdenum complex comprises an oil-soluble molybdenum salt selected from the group consisting of molybdenum alkyl dithiophosphate and molybdenum alkyl dithiocarbamate; and up to about 5% by weight of liquefacted boron nitride, the liquefacted boron nitride prepared from the solvation of exfoliated solid boron nitride within a liquid carrier. In various embodiments, the composition is homogeneous and has no visible suspended or settled boron nitride particles. In various embodiments, each of the composition components in addition to the boron nitride are dissolved or liquefacted within the base oil, thereby forming a solution having zero visible suspended or settled particles. In various embodiments, the transition metal lubricant comprises, or alternatively, consists of, the liquid molybdenum complex, the liquid molybdenum complex comprising one or more organic molybdenum compounds selected from the group consisting of MoDDP, MoDTC, molybdenum amide, and any combination thereof.

In another non-limiting example, the lubricant composition can comprise, or alternatively consist of, up to about 2% by weight of the transition metal lubricant and up to about 1% by weight of the sub-micronized and/or liquefacted boron nitride, wherein the balance is a base oil. In some embodiments, the transition metal lubricant comprises, or alternatively, consists of, organic molybdenum, comprising one or more organic molybdenum compounds selected from the group consisting of MoDDP, MoDTC, molybdenum amide, and any combination thereof.

In some embodiments, the mass ratio between the transition metal lubricant and the sub-micronized and/or liquefacted boron nitride in any of the above lubricant compositions can be any value in the range from 1:100 to 100:1, including any sub-range between and inclusive of 1:100 and 100:1. Preferably the mass ratio between the transition metal lubricant and the sub-micronized and/or liquefacted boron nitride in any of the above lubricant compositions can be any value in a range from 10:1 to 1:10, including any sub-range between and inclusive of 10:1 and 1:10. Non-limiting examples of such mass ratios are 7:1, 3:1, 1.5:1, 1:1, 1:1.5, and 1:3. In some embodiments, the mass ratio between the transition metal lubricant and the sub-micronized and/or liquefacted boron nitride in any of the above lubricant compositions is 3:1.

According to the present invention, the base oil can be any oil utilized as a lubricant to reduce the wear and friction associated with two or more solid surfaces moving in close contact relative to each other. Non-limiting examples of base oils are: industrial gear oil; automotive gear oil; open gear oils and greases, such as used in the oil and gas industry, sugar mills, and rock crushers; rock drill, pneumatic, and air tool oils; anti-seize compounds; cutting oils; gun oils; engine oil; air compressor oil; slideway lubricants; bearing oil; oven, kiln, and foundry lubricants; metalworking and metalforming lubricants; and aerospace lubricants. In some embodiments, lubricant compositions of the present invention can be formulated to provide performance characteristics including, but not limited to, extreme pressure protection, low coefficient of friction, anti-wear protection, high-temperature resistance, and combinations thereof. In some embodiments, lubricant compositions of the present invention can provide or facilitate such key benefits including, but not limited to, shock loading, high film strength, high load carrying capacity, high efficiency, low frictional heating, long oil life, high speed use, low sliding wear, and ceramic chemistry.

According to the present invention, within any of the lubricant compositions described herein in which molybdenum is present, the lubricant composition can further comprise a molybdenum activator. In some embodiments, the molybdenum activator comprises two or more sulfurized lubricant additive compounds, the two or more sulfurized lubricant additive compounds selected from the group consisting of: a sulfurized methyl ether; a sulfurized fat; a sulfurized olefin; an alkyl dithiocarbamate; an alkyl dithiophosphate; an alkyl dimercaptothiadiazole; and combinations thereof. In some embodiments, the lubricant composition comprises any concentration of molybdenum activator up to about 0.01, 0.05, 0.1, 0.2, 0.25, 0.3, 0.4, 0.5, 0.6, 0.7, 0.75, 0.8, 0.9, 1.0, 1.25, 1.5, 1.75, 2, 2.25, 2.5, 2.75, 3, 3.25, 3.5, 3.75, 4, 4.25, 4.5, 4.75, 5, 5.25, 5.5, 5.75, 6, 6.25, 6.5, 6.75, 7, 7.25, 7.5, 7.75, 8, 8.25, 8.5, 8.75, 9, 9.25, 9.5, 9.75, or 10% by weight of the composition. In some embodiments, the concentration of the molybdenum activator can be any value between and inclusive of at least about 0.01% by weight and up to about 10% by weight, including any sub-range between and inclusive of about 0.01% by weight and up to about 10% by weight. Preferably, the concentration of the molybdenum activator can be any value between and inclusive of at least about 0.5% by weight up to about 5% by weight, including any sub-range between and inclusive of about 0.5% by weight and 5% by weight. More preferably, the concentration of the molybdenum activator can be any value between and inclusive of at least about 2.0% by weight up to about 4.7% by weight of the composition, including any sub-range between and inclusive of about 2.0% by weight and about 4.7% by weight. Non-limiting examples of concentrations of molybdenum activator within the lubricant composition are 0.01, 0.05, 0.1, 0.2, 0.25, 0.3, 0.4, 0.5, 0.6, 0.7, 0.75, 0.8, 0.9, 1.0, 1.25, 1.5, 1.75, 2, 2.25, 2.5, 2.75, 3, 3.25, 3.5, 3.75, 4, 4.25, 4.5, 4.7, 4.75, 5, 5.25, 5.5, 5.75, 6, 6.25, 6.5, 6.75, 7, 7.25, 7.5, 7.75, 8, 8.25, 8.5, 8.75, 9, 9.25, 9.5, 9.75, or 10% by weight. In some embodiments, any of the above concentrations or sub-ranges of concentrations of molybdenum activator can be utilized in compositions in which sub-micronized and/or liquefacted tungsten disulfide is present.

In some embodiments, a lubricant composition can comprise, or alternatively, consist of, a base oil, sub-micronized and/or liquefacted boron nitride, a transition metal lubricant, and a molybdenum activator. In some embodiments, a lubricant composition can comprise, or alternatively, consist of, a base oil, a transition metal lubricant, and a molybdenum activator. In some embodiments, each of the sub-micronized and/or liquefacted boron nitride, transition metal lubricant, and molybdenum activator, when present within the lubricant composition, can be present in any of their respective concentration values, ranges, or sub-ranges described herein and above.

According to the present invention, any of the lubricant compositions described herein can further comprise a surface treatment mixture. In some embodiments, the surface treatment mixture can comprise medium-chain- and long-chain paraffinic distillates. In some embodiments, the surface treatment mixture comprises long-chain paraffinic distillates. In some embodiments, the surface treatment mixture consists of long-chain paraffinic distillates. In some embodiments, the medium- and/or long-chain paraffinic distillates can comprise n-alkanes, isoalkanes, and/or cycloalkanes (napthenes). In some embodiments, the surface treatment mixture comprises at least one hydrogenated paraffinic or naphthenic petroleum distillate. In some embodiments, the medium- and/or long-chain paraffinic distillates can be chlorinated. In some embodiments, the lubricant composition comprises any concentration of a surface treatment mixture, the surface treatment mixture comprising paraffinic distillates of any combination of chain-length, isomerism, and/or chirality, up to about 0.01, 0.05, 0.1, 0.2, 0.25, 0.3, 0.4, 0.5, 0.6, 0.7, 0.75, 0.8, 0.9, 1.0, 1.25, 1.5, 1.75, 2, 2.25, 2.5, 2.75, 3, 3.25, 3.5, 3.75, 4, 4.25, 4.5, 4.75, 5, 5.25, 5.5, 5.75, 6, 6.25, 6.5, 6.75, 7, 7.25, 7.5, 7.75, 8, 8.25, 8.5, 8.75, 9, 9.25, 9.5, 9.75, or 10% by weight of the composition. In some embodiments, the concentration of the surface treatment mixture can be any value between and inclusive of at least about 0.01% by weight and up to about 10% by weight, including any sub-range of concentrations between and inclusive of about 0.01% by weight and about 10% by weight. Preferably, the concentration of the surface treatment mixture can be any value between and inclusive of at least about 1% by weight and up to about 8% by weight of the composition, including any sub-range of concentrations between and inclusive of about 1% by weight and 8% by weight. Non-limiting examples of concentrations of a surface treatment mixture are 0.01, 0.05, 0.1, 0.2, 0.25, 0.3, 0.4, 0.5, 0.6, 0.7, 0.75, 0.8, 0.9, 1.0, 1.25, 1.5, 1.75, 2, 2.25, 2.5, 2.75, 3, 3.25, 3.5, 3.75, 4, 4.25, 4.5, 4.75, 5, 5.25, 5.5, 5.75, 6, 6.25, 6.5, 6.75, 7, 7.25, 7.5, 7.75, 8, 8.25, 8.5, 8.75, 9, 9.25, 9.5, 9.75, or 10% by weight. In one non-limiting example, and in some embodiments, the composition further comprises up to about 10% by weight of a surface treatment mixture, wherein the surface treatment mixture comprises at least one hydrogenated paraffinic or naphthenic petroleum distillate.

In some embodiments, a lubricant composition can comprise, or alternatively, consist of, a base oil, sub-micronized and/or liquefacted boron nitride, a transition metal lubricant, a molybdenum activator, and a surface treatment mixture. In some embodiments, a lubricant composition can comprise, or alternatively consist of, a base oil, a transition metal lubricant, a molybdenum activator, and a surface treatment mixture. In some embodiments, a lubricant composition can comprise, or alternatively consist of, a base oil, sub-micronized and/or liquefacted boron nitride, a transition metal lubricant, and a surface treatment mixture. In some embodiments, a lubricant composition can comprise, or alternatively consist of, a base oil, a transition metal lubricant, and a surface treatment mixture. In some embodiments, a lubricant composition can comprise, or alternatively consist of, a base oil, sub-micronized and/or liquefacted boron nitride and a surface treatment mixture. In some embodiments, each of the sub-micronized and/or liquefacted boron nitride, transition metal lubricant, molybdenum activator, and surface treatment mixture, when present within the lubricant composition, can be present in any of their respective concentration values, ranges, or sub-ranges described herein and above.

According to the present invention, any of the lubricant compositions described herein can further comprise an inorganic salt, particularly an inorganic fluoride salt. Non-limiting examples of an inorganic fluoride salt are calcium fluoride, lithium fluoride, and magnesium chloride, and in some embodiments, the inorganic fluoride salt can be selected from the group consisting of: calcium fluoride; lithium fluoride; magnesium fluoride; and any combination thereof. In some embodiments, the inorganic fluoride salt is calcium fluoride.

In some embodiments, the lubricant composition comprises any concentration of an inorganic salt, preferably an inorganic fluoride salt selected from the group consisting of: calcium fluoride; lithium fluoride; magnesium fluoride, and any combination thereof; and more preferably calcium fluoride, up to about 0.001, 0.0025, 0.005, 0.0075, 0.01, 0.015, 0.02, 0.025, 0.03, 0.035, 0.04, 0.045, 0.05, 0.055, 0.06, 0.065, 0.07, 0.075, 0.08, 0.085, 0.09, 0.095, 0.1, 0.125, 0.15, 0.175, 0.2, 0.225, 0.25, 0.275, 0.3, 0.35, 0.4, 0.45, 0.5, 0.6, 0.7, 0.75, 0.8, 0.9, or 1.0 by weight of the composition. In some embodiments, the concentration of the inorganic fluoride salt can be any value between and inclusive of at least about 0.001% by weight and about 1.0% by weight, including any sub-range of concentrations between and inclusive of about 0.001% by weight and about 1.0% by weight. Preferably, an inorganic fluoride salt selected from the group consisting of: calcium fluoride; lithium fluoride; magnesium fluoride, and any combination thereof; and more preferably calcium fluoride, can have a concentration of any value between and inclusive of at least about 0.001% by weight and up to about 0.2% by weight of the composition, including any sub-range of concentrations between and inclusive of about 0.001% by weight and about 0.2% by weight. More preferably, an inorganic fluoride salt selected from the group consisting of: calcium fluoride; lithium fluoride; magnesium fluoride, and any combination thereof; and more preferably calcium fluoride, can have a concentration of any value between and inclusive of at least about 0.01% by weight and up to about 0.1% by weight of the composition, including any sub-range of concentrations between and inclusive of about 0.01% by weight and about 0.1% by weight. Non-limiting examples of concentrations of an inorganic salt, preferably an inorganic fluoride salt selected from the group consisting of: calcium fluoride; lithium fluoride; magnesium fluoride, and any combination thereof; and more preferably calcium fluoride, within the lubricant composition are 0.001, 0.0025, 0.005, 0.0075, 0.01, 0.015, 0.02, 0.025, 0.03, 0.035, 0.04, 0.045, 0.05, 0.055, 0.06, 0.065, 0.07, 0.075, 0.08, 0.085, 0.09, 0.095, 0.1, 0.125, 0.15, 0.175, 0.2, 0.225, 0.25, 0.275, 0.3, 0.35, 0.4, 0.45, 0.5, 0.6, 0.7, 0.75, 0.8, 0.9, or 1.0 by weight.

In some embodiments, a lubricant composition can comprise, or alternatively, consist of, a base oil, sub-micronized and/or liquefacted boron nitride, a transition metal lubricant, a molybdenum activator, a surface treatment mixture, and an inorganic salt. In some embodiments, a lubricant composition can comprise, or alternatively consist of, a base oil, a transition metal lubricant, a molybdenum activator, a surface treatment mixture, and an inorganic salt. In some embodiments, a lubricant composition can comprise, or alternatively consist of, a base oil, a transition metal lubricant, a surface treatment mixture, and an inorganic salt. In some embodiments, a lubricant composition can comprise, or alternatively consist of, a base oil, sub-micronized and/or liquefacted boron nitride, a transition metal lubricant, a surface treatment mixture, and an inorganic salt. In some embodiments, a lubricant composition can comprise, or alternatively consist of, a base oil, sub-micronized and/or liquefacted boron nitride, a surface treatment mixture, and an inorganic salt. In some embodiments, a lubricant composition can comprise, or alternatively consist of, a base oil, sub-micronized and/or liquefacted boron nitride, a transition metal lubricant, a molybdenum activator, and an inorganic salt. In some embodiments, a lubricant composition can comprise, or alternatively consist of, a base oil, sub-micronized and/or liquefacted boron nitride, a transition metal lubricant, and an inorganic salt. In some embodiments, a lubricant composition can comprise, or alternatively consist of, a base oil, sub-micronized and/or liquefacted boron nitride and an inorganic salt. In some embodiments, a lubricant composition can comprise, or alternatively consist of, a base oil, a transition metal lubricant, a molybdenum activator, and an inorganic salt. In some embodiments, a lubricant composition can comprise, or alternatively consist of, a base oil, a transition metal lubricant and an inorganic salt. In some embodiments, each of the sub-micronized and/or liquefacted boron nitride, transition metal lubricant, molybdenum activator, surface treatment mixture, and inorganic salt, when present within the lubricant composition, can be present in any of their respective concentration values, ranges, or sub-ranges described herein and above.

According to the present invention, an inorganic fluoride salt can be prepared as a liquid composition, wherein the inorganic fluoride salt is solubilized within a mixture of one or more oil-soluble weak organic acids and one or more oil-soluble strong organic acids, forming an inorganic fluoride salt composition. In some embodiments, the one or more oil-soluble weak organic acids are selected from the group consisting of: an alkyl carboxylic acid; an aryl carboxylic acid; any Lewis acid having a pKa greater than 4.0; and any combination thereof. In some embodiments, the one or more oil-soluble strong acids are selected from the group consisting of: an alkyl sulfonate; an aryl sulfonate; any phosphate acid having a pKa lower than 4.0; and any combination thereof. In some embodiments, within any of the compositions described herein comprising an inorganic fluoride salt, the inorganic fluoride salt composition can comprise up to about 0.01, 0.05, 0.1, 0.2, 0.3, 0.4, 0.5, 0.6, 0.7, 0.8, 0.9, 1, 1.25, 1.5, 1.75, 2, 2.25, 2.5, 2.75, 3, 3.25, 3.5, 3.75, 4, 4.25, 4.5, 4.75, or 5% by weight of the composition. In some embodiments, the concentration of the inorganic fluoride salt composition can be any value up to about 5% by weight, including any sub-range of concentrations between 0% by weight and less than or equal to about 5% by weight. Preferably, the concentration of the inorganic fluoride salt composition can be any value between and inclusive of at least about 0.01% by weight up to about 2% by weight of the composition, including any sub-range between and inclusive of about 0.01% by weight and about 2% by weight. More preferably, the concentration of the inorganic fluoride salt composition can be any value between and inclusive of at least about 0.1% by weight up to about 1% by weight of the composition, including any sub-range between and inclusive of about 0.1% by weight and about 1% by weight. Non-limiting examples of concentrations of the inorganic fluoride salt composition are 0.01, 0.05, 0.1, 0.125, 0.2, 0.25, 0.3, 0.4, 0.5, 0.6, 0.7, 0.75, 0.8, 0.9, 1, 1.25, 1.5, 1.75, 2, 2.25, 2.5, 2.75, 3, 3.25, 3.5, 3.75, 4, 4.25, 4.5, 4.75, or 5% by weight.

According to the present invention, any of the lubricant compositions described herein can further comprise a polymeric dispersant, the polymeric dispersant comprising one or more oil-soluble copolymers of olefins with a polymeric amine core. Non-limiting examples of olefins comprised within the polymeric dispersant are ethylene, propylene, butylene, and any other acyclic or cyclic hydrocarbon with one or more double bonds.

In some embodiments, the lubricant composition can comprise any concentration of a polymeric dispersant up to about 0.01, 0.05, 0.1, 0.2, 0.3, 0.4, 0.5, 0.6, 0.7, 0.8, 0.9, 1, 1.25, 1.5, 1.75, 2, 2.25, 2.5, 2.75, 3, 3.25, 3.5, 3.75, 4, 4.25, 4.5, 4.75, or 5% by weight of the composition. In some embodiments, the concentration of the inorganic fluoride salt composition can be any value up to about 5% by weight, including any sub-range of concentrations between 0% by weight and less than or equal to about 5% by weight of the composition. Non-limiting examples of concentrations of a polymeric dispersant are 0.01, 0.05, 0.1, 0.125, 0.2, 0.25, 0.3, 0.4, 0.5, 0.6, 0.7, 0.75, 0.8, 0.9, 1, 1.25, 1.5, 1.75, 2, 2.25, 2.5, 2.75, 3, 3.25, 3.5, 3.75, 4, 4.25, 4.5, 4.75, or 5% by weight.

In some embodiments, a lubricant composition can comprise, or alternatively consist of, a base oil, sub-micronized and/or liquefacted boron nitride, a transition metal lubricant, a molybdenum activator, a surface treatment mixture, an inorganic salt, and a polymeric dispersant. In some embodiments, a lubricant composition can comprise, or alternatively consist of, a base oil, sub-micronized and/or liquefacted boron nitride, a transition metal lubricant, a surface treatment mixture, an inorganic salt, and a polymeric dispersant. In some embodiments, a lubricant composition can comprise, or alternatively consist of, a base oil, a transition metal lubricant, a surface treatment mixture, and a polymeric dispersant. In some embodiments, each of the sub-micronized and/or liquefacted boron nitride, transition metal lubricant, molybdenum activator, surface treatment mixture, inorganic salt, and polymeric dispersant, when present within the lubricant composition, can be present in any of their respective concentration values, ranges, or sub-ranges described herein and above.

According to the present invention, any of the lubricant compositions described herein can further comprise a viscosity modifier. In some embodiments, the viscosity modifier can be preferably selected from the group consisting of: a mixture of one or more medium-to high-molecular weight olefin copolymers; and a mixture of one or more polymethacrylate copolymers of a methacrylic acid esters.

In some embodiments, the lubricant composition can comprise any concentration of a viscosity modifier up to about 0.01, 0.1, 0.5, 1, 1.5, 2, 3, 4, 5, 7.5, 10, 12.5, 15, 17.5, or 20% by weight of the composition. In some embodiments, the concentration of the viscosity modifier can be any value up to about 20% by weight, including any sub-range of concentrations between 0% by weight and less than or equal to about 20% by weight of the composition. Preferably, the concentration of viscosity modifier can be any value between and inclusive of at least about 5% by weight up to about 15% by weight of the composition, including any sub-range between and inclusive of about 5% by weight and about 15% by weight. Non-limiting examples of concentrations of a viscosity modifier within the lubricant composition are 0.01, 0.1, 0.5, 1, 1.5, 2, 3, 4, 5, 7.5, 10, 12.5, 15, 17.5, or 20% by weight.

In some embodiments, a lubricant composition can comprise, or alternatively consist of, a base oil, sub-micronized and/or liquefacted boron nitride, a transition metal lubricant, a molybdenum activator, a surface treatment mixture, an inorganic salt, a polymeric dispersant, and a viscosity modifier. In some embodiments, a lubricant composition can comprise, or alternatively consist of, a base oil, sub-micronized and/or liquefacted boron nitride, a transition metal lubricant, a surface treatment mixture, an inorganic salt, a polymeric dispersant, and a viscosity modifier. In some embodiments, a lubricant composition can comprise, or alternatively consist of, a base oil, sub-micronized and/or liquefacted boron nitride, a transition metal lubricant, a molybdenum activator, a surface treatment mixture, an inorganic salt, and a viscosity modifier. In some embodiments, a lubricant composition can comprise, or alternatively consist of, a base oil, sub-micronized and/or liquefacted boron nitride, a transition metal lubricant, a surface treatment mixture, an inorganic salt, and a viscosity modifier. In some embodiments, a lubricant composition can comprise, or alternatively consist of, a base oil, a transition metal lubricant, a surface treatment mixture, an inorganic salt, a polymeric dispersant, and a viscosity modifier. In some embodiments, a lubricant composition can comprise, or alternatively consist of, a base oil, a transition metal lubricant, a surface treatment mixture, an inorganic salt, and a viscosity modifier. In some embodiments, each of the sub-micronized and/or liquefacted boron nitride, transition metal lubricant, molybdenum activator, surface treatment mixture, inorganic salt, polymeric dispersant, and viscosity modifier, when present within the lubricant composition, can be present in any of their respective concentration values, ranges, or sub-ranges described herein and above.

The embodiments and features described herein also provide additive compositions, which can be formulated to be combined with a base oil and produce any of the lubricant compositions described above. In some embodiments, the additive composition can comprise one or more of the composition components described above, in any combination described above, the components selected from the group consisting of a transition metal lubricant, sub-micronized and/or liquefacted boron nitride, a molybdenum activator, a surface treatment mixture, an inorganic salt, a polymeric dispersant, and a viscosity modifier. In some embodiments, the transition metal lubricant within an additive composition can be selected from the group consisting of sub-micronized and/or liquefacted tungsten disulfide, sub-micronized and/or liquefacted molybdenum disulfide, and a liquid molybdenum complex, wherein the liquid molybdenum complex comprises an oil-soluble molybdenum salt, the oil-soluble molybdenum salt preferably selected from the group consisting of molybdenum alkyl dithiophosphate and molybdenum alkyl dithiocarbamate. In some embodiments, the molybdenum activator within an additive composition can comprise two or more sulfurized lubricant additive compounds, the two or more sulfurized lubricant additive compounds selected from the group consisting of: a sulfurized methyl ether; a sulfurized fat; a sulfurized olefin; an alkyl dithiocarbamate; an alkyl dithiophosphate; an alkyl dimercaptothiadiazole; and combinations thereof. In some embodiments, the surface treatment mixture within an additive composition can comprise medium-chain paraffinic distillates and long-chain paraffinic distillates, particularly long-chain paraffinic distillates, and more particularly consist of long-chain paraffinic distillates. In some embodiments, the inorganic salt within an additive composition is an inorganic fluoride salt selected from the group consisting of: calcium fluoride; lithium fluoride; magnesium fluoride; and any combination thereof. In some embodiments, the inorganic fluoride salt is calcium fluoride. In some embodiments, the inorganic fluoride salt within the additive composition can be included as a liquid composition, wherein the inorganic fluoride salt is solubilized within a mixture of one or more oil-soluble weak organic acids and one or more oil-soluble strong organic acids, forming an inorganic fluoride salt composition.

In some embodiments, an additive composition can comprise any concentration of sub-micronized and/or liquefacted boron nitride up to about 0.1, 0.25, 0.5, 1, 2, 3, 4, 5, 7.5, 10, 12, 15, 20, 25, 30, 40, 50, 60, 70, or 80% by weight of the composition. In some embodiments, the concentration of sub-micronized and/or liquefacted boron nitride within the additive composition can be any value between and inclusive of at least about 0.1% by weight and up to about 80% by weight, including any sub-range between and inclusive of about 0.1% by weight and about 80% by weight. Preferably, the concentration of sub-micronized and/or liquefacted boron nitride within the additive composition can be any value between and inclusive of at least about 0.5% by weight up to about 25% by weight of the composition, including any sub-range between and inclusive of about 0.5% by weight and about 25% by weight. More preferably, the concentration of sub-micronized and/or liquefacted boron nitride within the additive composition can be any value between and inclusive of at least about 1% by weight up to about 12% by weight of the composition, including any sub-range between and inclusive of about 1% by weight and about 12% by weight. Non-limiting examples of concentrations of sub-micronized and/or liquefacted boron nitride within an additive composition are 0.1, 0.25, 0.5, 1, 2, 3, 4, 5, 7.5, 10, 12, 15, 20, 25, 30, 40, 50, 60, 70, or 80% by weight.

In some embodiments, an additive composition can comprise any concentration of a transition metal lubricant up to about 1, 2, 3, 4, 5, 7.5, 10, 12, 15, 20, 25, 30, 40, 50, 60, 70, 75, 80, or 90% by weight of the composition, wherein the transition metal lubricant can comprise one or more compounds selected from the group consisting of tungsten disulfide, sub-micronized and/or liquefacted molybdenum disulfide, organic molybdenum, and any combination thereof. In some embodiments, the organic molybdenum can comprise one or more oil-soluble molybdenum salts selected from the group consisting of MoDDP, MoDTC, molybdenum amide, and combinations thereof. In some embodiments, the concentration of transition metal lubricant within the additive composition can be any value between and inclusive of at least 1% by weight and up to about 90% by weight, including any sub-range between and inclusive of about 1% by weight and about 90% by weight. Preferably, the concentration of transition metal lubricant within the additive composition can be any value between and inclusive of at least about 5% by weight up to about 75% by weight of the composition, including any sub-range between and inclusive of about 5% by weight and about 75% by weight. More preferably, the concentration of transition metal lubricant within the additive composition can be any value between and inclusive of at least about 10% by weight up to about 55% by weight of the composition, including any sub-range between and inclusive of about 10% by weight and about 55% by weight. Non-limiting examples of concentrations of transition metal lubricant within an additive composition are 1, 2, 3, 4, 5, 7.5, 10, 12, 15, 20, 25, 30, 40, 50, 60, 70, 75, 80, or 90% by weight.

In some embodiments, the additive composition can comprise, or alternatively consist of, sub-micronized and/or liquefacted boron nitride and a transition metal lubricant, wherein the sub-micronized and/or liquefacted boron nitride and transition metal lubricant can be present within the composition in any of their respective concentration values, ranges, or sub-ranges described herein and above. In some embodiments, the additive composition can comprise a transition metal lubricant but not boron nitride, and the transition metal lubricant can be present within the composition in any of the concentration values, ranges, or sub-ranges described herein and above.

In a non-limiting example, a liquid additive composition of the present invention can comprise: up to 90% by weight, preferably from 5% by weight up to 75% by weight, and more preferably from 10% by weight up to 55% by weight of one or more transition metal lubricants, the transition metal lubricants selected from the group consisting of sub-micronized tungsten disulfide, sub-micronized molybdenum disulfide, and a liquid molybdenum complex, wherein the liquid molybdenum complex comprises an oil-soluble molybdenum salt, the oil-soluble molybdenum salt preferably selected from the group consisting of molybdenum alkyl dithiophosphate and molybdenum alkyl dithiocarbamate; and up to 80% by weight, preferably from 0.5% by weight up to 25% by weight, and more preferably from 1% by weight up to 12% by weight of sub-micronized boron nitride, the sub-micronized boron nitride comprising boron nitride particles having a particle size less than about 100 nm. In various embodiments, at least 50%, 55%, 60%, 65%, 70%, 75%, 80%, 85%, 90%, 95%, 97%, or 99% of the sub-micronized boron nitride particles have a particle size less than 100 nm. In various embodiments, the sub-micronized boron nitride particles consist of boron nitride particles having a particle size less than 100 nm.

In another non-limiting example, a liquid additive composition of the present invention can comprise: from about 10% by weight up to 55% by weight of a liquid molybdenum complex comprising an oil-soluble molybdenum salt selected from the group consisting of molybdenum alkyl dithiophosphate and molybdenum alkyl dithiocarbamate; and up to about 80% by weight of a sub-micronized boron nitride, the sub-micronized boron nitride comprising boron nitride particles having a particle size less than about 100 nm. In various embodiments, at least 50%, 55%, 60%, 65%, 70%, 75%, 80%, 85%, 90%, 95%, 97%, or 99% of the sub-micronized boron nitride particles have a particle size less than 100 nm. In various embodiments, the sub-micronized boron nitride particles consist of boron nitride particles having a particle size less than 100 nm.

In another non-limiting example, a liquid additive composition of the present invention can comprise: from about 10% by weight up to 55% by weight of a liquid molybdenum complex comprising an oil-soluble molybdenum salt selected from the group consisting of molybdenum alkyl dithiophosphate and molybdenum alkyl dithiocarbamate; and up to about 80% by weight of liquefacted boron nitride, the liquefacted boron nitride prepared from the solvation of exfoliated solid boron nitride within a liquid carrier. In various embodiments, the additive composition is homogeneous and has no visible suspended or settled boron nitride particles. In various embodiments, each of the composition components in addition to the boron nitride are dissolved or liquefacted within the liquid carrier for the liquefacted boron nitride and/or the oil within which the molybdenum salt is solubilized, thereby forming a solution having zero visible suspended or settled particles. In various embodiments, the liquid molybdenum complex comprises one or more organic molybdenum compounds selected from the group consisting of MoDDP, MoDTC, molybdenum amide, and any combination thereof.

In some embodiments, within any of the additive compositions described herein in which molybdenum is present, the additive composition can further comprise a molybdenum activator, the molybdenum activator comprising any two or more of the sulfurized lubricant additive compounds described herein and above. In some embodiments, the additive composition comprises any concentration of molybdenum activator up to about 0.1, 0.5, 1, 2.5, 5, 7.5, 10, 15, 20, 25, 30, 35, 40, 45, 50, 60, 65, or 70% by weight of the composition. In some embodiments, the concentration of the molybdenum activator within the additive composition can be any value between and inclusive of at least about 0.1% by weight and up to about 70% by weight, including any sub-range between and inclusive of about 0.1% by weight and up to about 70% by weight. Preferably, the concentration of the molybdenum activator within the additive composition can be any value between and inclusive of at least about 15% by weight up to about 65% by weight, including any sub-range between and inclusive of about 15% by weight and 65% by weight. Non-limiting examples of concentrations of molybdenum activator within the additive composition are 0.1, 0.5, 1, 2.5, 5, 7.5, 10, 15, 20, 25, 30, 35, 40, 45, 50, 60, 65, or 70% by weight. In some embodiments, any of the above concentrations or sub-ranges of concentrations of molybdenum activator can be utilized in additive compositions in which sub-micronized and/or liquefacted tungsten disulfide is present.

In some embodiments, an additive composition can comprise, or alternatively consist of, sub-micronized and/or liquefacted boron nitride, a transition metal lubricant, and a molybdenum activator, wherein each component can be present within the composition in any of their respective concentration values, ranges, or sub-ranges described herein and above. In some embodiments, an additive composition can comprise, or alternatively consist of, a transition metal lubricant and a molybdenum activator, wherein each component can be present within the composition in any of their respective concentration values, ranges, or sub-ranges described herein and above.

In a non-limiting example, an additive composition of the present invention can comprise from about 10% by weight up to 55% by weight of a liquid molybdenum complex comprising an oil-soluble molybdenum salt selected from the group consisting of molybdenum alkyl dithiophosphate and molybdenum alkyl dithiocarbamate; up to about 70% by weight of a molybdenum activator, wherein the molybdenum activator comprises two or more sulfurized lubricant additive compounds, the two or more sulfurized lubricant additive compounds selected from the group consisting of: a sulfurized methyl ether; a sulfurized fat; a sulfurized olefin; an alkyl dithiocarbamate; an alkyl dithiophosphate; an alkyl dimercaptothiadiazole; and any combination thereof; and up to about 80% by weight of a sub-micronized boron nitride, the sub-micronized boron nitride comprising boron nitride particles having a particle size less than about 100 nm. In various embodiments, at least 50%, 55%, 60%, 65%, 70%, 75%, 80%, 85%, 90%, 95%, 97%, or 99% of the sub-micronized boron nitride particles have a particle size less than 100 nm. In various embodiments, the sub-micronized boron nitride particles consist of boron nitride particles having a particle size less than 100 nm.

In some embodiments, an additive composition can comprise any concentration of a surface treatment mixture up to about 1, 2, 3, 4, 5, 7.5, 10, 12, 15, 20, 25, 30, 35, 40, 50, 60, 70, 75, 80, or 90% by weight of the composition, wherein the surface treatment mixture can comprise any combination of medium-chain paraffinic distillates and long-chain paraffinic distillates described herein and above, including combinations that only contain long-chain paraffinic distillates. In some embodiments, the concentration of the surface treatment mixture within the additive composition can be any value between and inclusive of at least about 1% by weight and up to about 90% by weight, including any sub-range between and inclusive of about 1% by weight and up to about 90% by weight. Preferably, the concentration of the surface treatment mixture within the additive composition can be any value between and inclusive of at least about 10% by weight up to about 80% by weight, including any sub-range between and inclusive of about 10% by weight and 80% by weight. More preferably, the concentration of the surface treatment mixture within the additive composition can be any value between and inclusive of at least about 35% by weight up to about 70% by weight, including any sub-range between and inclusive of about 35% by weight and 70% by weight. Non-limiting examples of concentrations of molybdenum activator within the additive composition are 1, 2, 3, 4, 5, 7.5, 10, 12, 15, 20, 25, 30, 35, 40, 50, 60, 70, 75, 80, or 90% by weight.

In some embodiments, an additive composition can comprise, or alternatively consist of, sub-micronized and/or liquefacted boron nitride, a transition metal lubricant, a molybdenum activator, and a surface treatment mixture, wherein each component can be present within the composition in any of their respective concentration values, ranges, or sub-ranges described herein and above. In some embodiments, an additive composition can comprise, or alternatively consist of, a transition metal lubricant, a molybdenum activator, and a surface treatment mixture, wherein each component can be present within the composition in any of their respective concentration values, ranges, or sub-ranges described herein and above. In some embodiments, an additive composition can comprise, or alternatively consist of, sub-micronized and/or liquefacted boron nitride, a transition metal lubricant, and a surface treatment mixture, wherein each component can be present within the composition in any of their respective concentration values, ranges, or sub-ranges described herein and above. In some embodiments, an additive composition can comprise, or alternatively consist of, a transition metal lubricant and a surface treatment mixture, wherein each component can be present within the composition in any of their respective concentration values, ranges, or sub-ranges described herein and above. In some embodiments, an additive composition can comprise, or alternatively consist of, sub-micronized and/or liquefacted boron nitride and a surface treatment mixture, wherein each component can be present within the composition in any of their respective concentration values, ranges, or sub-ranges described herein and above.

In some embodiments, an additive composition can comprise any concentration of an inorganic salt, preferably an inorganic fluoride salt selected from the group consisting of calcium fluoride, lithium fluoride, magnesium fluoride, and any combination thereof, and more preferably calcium fluoride, up to about 0.01, 0.025, 0.05, 0.075, 0.1, 0.15, 0.2, 0.25, 0.3, 0.4, 0.5, 0.6, 0.7, 0.8, 0.9, 1.0, 2.0, 3.0, 4.0, or 5.0% by weight of the composition. In some embodiments, the concentration of the inorganic salt within the additive composition can be any value between and inclusive of at least about 0.01% by weight and up to about 5.0% by weight, including any sub-range between and inclusive of about 0.01% by weight and up to about 5.0% by weight. Preferably, the concentration of the inorganic salt within the additive composition can be any value between and inclusive of at least about 0.05% by weight up to about 0.8% by weight, including any sub-range between and inclusive of about 0.05% by weight and 0.8% by weight. Non-limiting examples of concentrations of inorganic salt within the additive composition are 0.01, 0.025, 0.05, 0.075, 0.1, 0.15, 0.2, 0.25, 0.3, 0.4, 0.5, 0.6, 0.7, 0.8, 0.9, 1.0, 2.0, 3.0, 4.0, or 5.0% by weight.

In some embodiments, an additive composition can comprise, or alternatively consist of, sub-micronized and/or liquefacted boron nitride, a transition metal lubricant, a molybdenum activator, a surface treatment mixture, and an inorganic salt, wherein each component can be present within the composition in any of their respective concentration values, ranges, or sub-ranges described herein and above. In some embodiments, an additive composition can comprise, or alternatively consist of, a transition metal lubricant, a molybdenum activator, a surface treatment mixture, and an inorganic salt, wherein each component can be present within the composition in any of their respective concentration values, ranges, or sub-ranges described herein and above. In some embodiments, an additive composition can comprise, or alternatively consist of, a transition metal lubricant, a surface treatment mixture, and an inorganic salt, wherein each component can be present within the composition in any of their respective concentration values, ranges, or sub-ranges described herein and above. In some embodiments, an additive composition can comprise, or alternatively consist of, sub-micronized and/or liquefacted boron nitride, a transition metal lubricant, a surface treatment mixture, and an inorganic salt, wherein each component can be present within the composition in any of their respective concentration values, ranges, or sub-ranges described herein and above. In some embodiments, an additive composition can comprise, or alternatively consist of, sub-micronized and/or liquefacted boron nitride, a surface treatment mixture, and an inorganic salt, wherein each component can be present within the composition in any of their respective concentration values, ranges, or sub-ranges described herein and above. In some embodiments, an additive composition can comprise, or alternatively consist of, sub-micronized and/or liquefacted boron nitride, a transition metal lubricant, a molybdenum activator, and an inorganic salt, wherein each component can be present within the composition in any of their respective concentration values, ranges, or sub-ranges described herein and above. In some embodiments, an additive composition can comprise, or alternatively consist of, sub-micronized and/or liquefacted boron nitride, a transition metal lubricant, and an inorganic salt, wherein each component can be present within the composition in any of their respective concentration values, ranges, or sub-ranges described herein and above. In some embodiments, an additive composition can comprise, or alternatively consist of, sub-micronized and/or liquefacted boron nitride and an inorganic salt, wherein each component can be present within the composition in any of their respective concentration values, ranges, or sub-ranges described herein and above. In some embodiments, an additive composition can comprise, or alternatively consist of, a transition metal lubricant, a molybdenum activator, and an inorganic salt, wherein each component can be present within the composition in any of their respective concentration values, ranges, or sub-ranges described herein and above. In some embodiments, an additive composition can comprise, or alternatively consist of, a transition metal lubricant and an inorganic salt, wherein each component can be present within the composition in any of their respective concentration values, ranges, or sub-ranges described herein and above.

In some embodiments, an inorganic fluoride salt comprised within an additive composition be prepared as a liquid composition, wherein the inorganic fluoride salt is solubilized within a mixture of any of the oil-soluble weak organic acids described herein and above, and one or more of any of the oil-soluble strong organic acids described herein and above, forming an inorganic fluoride salt composition. In some embodiments, within any of the additive compositions described herein and above comprising an inorganic fluoride salt, the inorganic fluoride salt composition can comprise up to about 0.1, 0.25, 0.5, 0.75, 1, 1.5, 2, 2.5, 3, 3.5, 4, 4.5, 5, 6, 7, 8, 9, 10, 11, 12, 13, 14, or 15% by weight of the composition. In some embodiments, the concentration of the inorganic fluoride salt composition within any of the additive compositions described herein and above can be any value up to about 15% by weight, including any sub-range of concentrations between 0% by weight and less than or equal to about 15% by weight. Preferably, the concentration of the inorganic fluoride salt composition within any of the additive compositions described herein and above can be any value between and inclusive of at least about 0.5% by weight up to about 8% by weight of the composition, including any sub-range between and inclusive of about 0.5% by weight and about 8% by weight. Non-limiting examples of concentrations of the inorganic fluoride salt composition within an additive composition are 0.1, 0.25, 0.5, 0.75, 1, 1.5, 2, 2.5, 3, 3.5, 4, 4.5, 5, 6, 7, 8, 9, 10, 11, 12, 13, 14, or 15% by weight.

According to the present invention, an additive composition can comprise any concentration of any of the polymeric dispersants described herein and above, up to about 0.1, 0.25, 0.5, 0.75, 1, 1.5, 2, 2.5, 3, 3.5, 4, 4.5, 5, 6, 7, 8, 9, 10, 11, 12, 13, 14, or 15% by weight of the composition. In some embodiments, the concentration of the polymeric dispersant within any of the additive compositions described herein and above can be any value up to about 15% by weight, including any sub-range of concentrations between 0% by weight and less than or equal to about 15% by weight. Non-limiting examples of concentrations of the polymeric dispersant within an additive composition are 0.1, 0.25, 0.5, 0.75, 1, 1.5, 2, 2.5, 3, 3.5, 4, 4.5, 5, 6, 7, 8, 9, 10, 11, 12, 13, 14, or 15% by weight.

In some embodiments, an additive composition can comprise, or alternatively consist of, sub-micronized and/or liquefacted boron nitride, a transition metal lubricant, a molybdenum activator, a surface treatment mixture, an inorganic salt, and a polymeric dispersant, wherein each component can be present within the composition in any of their respective concentration values, ranges, or sub-ranges described herein and above. In some embodiments, an additive composition can comprise, or alternatively consist of, sub-micronized and/or liquefacted boron nitride, a transition metal lubricant, a surface treatment mixture, an inorganic salt, and a polymeric dispersant, wherein each component can be present within the composition in any of their respective concentration values, ranges, or sub-ranges described herein and above. In some embodiments, an additive composition can comprise, or alternatively consist of, a transition metal lubricant, a surface treatment mixture, and a polymeric dispersant, wherein each component can be present within the composition in any of their respective concentration values, ranges, or sub-ranges described herein and above.

According to the present invention, an additive composition can comprise any concentration of any of the viscosity modifiers described herein and above, up to about 0.1, 0.5, 1, 2.5, 5, 10, 15, 20, 25, 30, 35, 40, 45, or 50% by weight of the composition. In some embodiments, the concentration of the viscosity modifier within any of the additive compositions described herein and above can be any value up to about 50% by weight, including any sub-range of concentrations between 0% by weight and less than or equal to about 50% by weight. Non-limiting examples of concentrations of the polymeric dispersant within an additive composition are 0.1, 0.5, 1, 2.5, 5, 10, 15, 20, 25, 30, 35, 40, 45, or 50% by weight.

In some embodiments, an additive composition can comprise, or alternatively consist of, sub-micronized and/or liquefacted boron nitride, a transition metal lubricant, a molybdenum activator, a surface treatment mixture, an inorganic salt, a polymeric dispersant, and a viscosity modifier, wherein each component can be present within the composition in any of their respective concentration values, ranges, or sub-ranges described herein and above. In some embodiments, an additive composition can comprise, or alternatively consist of, sub-micronized and/or liquefacted boron nitride, a transition metal lubricant, a surface treatment mixture, an inorganic salt, a polymeric dispersant, and a viscosity modifier, wherein each component can be present within the composition in any of their respective concentration values, ranges, or sub-ranges described herein and above. In some embodiments, an additive composition can comprise, or alternatively consist of, sub-micronized and/or liquefacted boron nitride, a transition metal lubricant, a molybdenum activator, a surface treatment mixture, an inorganic salt, and a viscosity modifier, wherein each component can be present within the composition in any of their respective concentration values, ranges, or sub-ranges described herein and above. In some embodiments, an additive composition can comprise, or alternatively consist of, sub-micronized and/or liquefacted boron nitride, a transition metal lubricant, a surface treatment mixture, an inorganic salt, and a viscosity modifier, wherein each component can be present within the composition in any of their respective concentration values, ranges, or sub-ranges described herein and above. In some embodiments, an additive composition can comprise, or alternatively consist of, a transition metal lubricant, a surface treatment mixture, an inorganic salt, a polymeric dispersant, and a viscosity modifier, wherein each component can be present within the composition in any of their respective concentration values, ranges, or sub-ranges described herein and above. In some embodiments, an additive composition can comprise, or alternatively consist of, a transition metal lubricant, a surface treatment mixture, an inorganic salt, and a viscosity modifier, wherein each component can be present within the composition in any of their respective concentration values, ranges, or sub-ranges described herein and above.

In various embodiments, a liquid additive composition formulated for addition to a base oil to provide enhanced lubrication and anti-wear properties under extreme pressure conditions, the additive composition comprising: up to 90% by weight, preferably from 5% by weight up to 75% by weight, and more preferably from 10% by weight up to 55% by weight one or more transition metal lubricants, the transition metal lubricants selected from the group consisting of sub-micronized tungsten disulfide, sub-micronized molybdenum disulfide, and a liquid molybdenum complex, wherein the liquid molybdenum complex comprises an oil-soluble molybdenum salt, the oil-soluble molybdenum salt preferably selected from the group consisting of molybdenum alkyl dithiophosphate and molybdenum alkyl dithiocarbamate; and up to 80% by weight, preferably from 0.5% by weight up to 25% by weight, and more preferably from 1% by weight up to 12% by weight of a sub-micronized boron nitride, the sub-micronized boron nitride comprising boron nitride particles having a particle size less than about 100 nm (Liquid Additive Composition 10). In various embodiments, at least 50%, 55%, 60%, 65%, 70%, 75%, 80%, 85%, 90%, 95%, 97%, or 99% of the sub-micronized boron nitride particles have a particle size less than 100 nm. In various embodiments, the sub-micronized boron nitride particles consist of boron nitride particles having a particle size less than 100 nm. In various embodiments, within Liquid Additive Composition 10, the transition metal consists of a liquid molybdenum complex (Liquid Additive Composition 11). In various embodiments, Liquid Additive Composition 11 can further comprise up to 70% by weight, and preferably from at least 15% by weight up to 65% by weight, of a molybdenum activator, wherein the molybdenum activator comprises two or more sulfurized lubricant additive compounds, the two or more sulfurized lubricant additive compounds selected from the group consisting of: a sulfurized methyl ether; a sulfurized fat; a sulfurized olefin; an alkyl dithiocarbamate; an alkyl dithiophosphate; an alkyl dimercaptothiadiazole; and any combination thereof (Liquid Additive Composition 12). In various embodiments, any of Liquid Additive Compositions 10-12 can further comprise up to about 90% by weight, preferably from at least 10% by weight up to 80% by weight, and more preferably from at least 35% by weight up to 70% by weight, of a surface treatment mixture, wherein the surface treatment mixture comprises at least one hydrogenated paraffinic or naphthenic petroleum distillate (Liquid Additive Composition 13). In various embodiments, any of Liquid Additive Compositions 10-13 can further comprise up to 1% by weight, and preferably from at least 0.05% by weight and up to 0.8% by weight, of an inorganic fluoride salt selected from the group consisting of: calcium fluoride; lithium fluoride; magnesium fluoride; and any combination thereof, wherein the inorganic fluoride salt is preferably calcium fluoride (Liquid Additive Composition 14). In further embodiments, the inorganic fluoride salt is solubilized within a mixture of one or more oil-soluble weak organic acids and one or more oil-soluble strong organic acids, forming an inorganic fluoride salt composition, wherein the inorganic fluoride salt composition comprises up to 10% by weight, preferably from at least 0.5% and up to 8% by weight of the additive composition, wherein the one or more oil-soluble weak organic acids are selected from the group consisting of: an alkyl carboxylic acid; an aryl carboxylic acid; any Lewis acid having a pKa greater than 4.0; and any combination thereof, and wherein the one or more oil-soluble strong acids are selected from the group consisting of: an alkyl sulfonate; an aryl sulfonate; any phosphate acid having a pKa lower than 4.0; and any combination thereof (Liquid Additive Composition 15). In various embodiments, any of Liquid Additive Compositions 10-15 can further comprise up to about 15% by weight of a polymeric dispersant, the polymeric dispersant comprising one or more oil-soluble copolymers of olefins having a polymeric amine core (Liquid Additive Composition 16). In various embodiments, any of Liquid Additive Compositions 10-16 can further comprise up to 50% by weight of a viscosity modifier, the viscosity modifier preferably selected from the group consisting of: a mixture of one or more medium-to high-molecular weight olefin copolymers; and a mixture of one or more polymethacrylate copolymers of a methacrylic acid esters (Liquid Additive Composition 17). In various embodiments, any of Liquid Additive Compositions 10-17 can further comprise up to 10% by weight of a colorant, preferably an oil-soluble dye (Liquid Additive Composition 18). In various embodiments, any of Liquid Additive Compositions 10-18 can be produced as a homogeneous composition having no visible suspended or settled particles. In various embodiments, any of Liquid Additive Compositions 10-18 can be added to a base oil selected from the group consisting of a gear oil; an engine oil; a hydraulic pump oil; a bearing oil; a way oil; a transmission or clutch fluid; an agricultural or construction equipment oil; and a mining, mill, or rock crusher oil.

In various embodiments, a liquid additive composition formulated for addition to a base oil to provide enhanced lubrication and anti-wear properties under extreme pressure conditions, the additive composition comprising: up to 90% by weight, preferably from 5% by weight up to 75% by weight, and more preferably from 10% by weight up to 55% by weight one or more transition metal lubricants, the transition metal lubricants selected from the group consisting of sub-micronized tungsten disulfide, sub-micronized molybdenum disulfide, and a liquid molybdenum complex, wherein the liquid molybdenum complex comprises an oil-soluble molybdenum salt, the oil-soluble molybdenum salt preferably selected from the group consisting of molybdenum alkyl dithiophosphate and molybdenum alkyl dithiocarbamate; and up to 80% by weight, preferably from 0.5% by weight up to 25% by weight, and more preferably from 1% by weight up to 12% by weight of liquefacted boron nitride, the liquefacted boron nitride prepared from the solvation of exfoliated solid boron nitride within a liquid carrier (Liquid Additive Composition 20). In various embodiments, within Liquid Additive Composition 20, the transition metal consists of a liquid molybdenum complex (Liquid Additive Composition 21). In various embodiments, Liquid Additive Composition 21 can further comprise up to 70% by weight, and preferably from at least 15% by weight up to 65% by weight, of a molybdenum activator, wherein the molybdenum activator comprises two or more sulfurized lubricant additive compounds, the two or more sulfurized lubricant additive compounds selected from the group consisting of: a sulfurized methyl ether; a sulfurized fat; a sulfurized olefin; an alkyl dithiocarbamate; an alkyl dithiophosphate; an alkyl dimercaptothiadiazole; and any combination thereof (Liquid Additive Composition 22). In various embodiments, any of Liquid Additive Compositions 20-22 can further comprise up to about 90% by weight, preferably from at least 10% by weight up to 80% by weight, and more preferably from at least 35% by weight up to 70% by weight, of a surface treatment mixture, wherein the surface treatment mixture comprises at least one hydrogenated paraffinic or naphthenic petroleum distillate (Liquid Additive Composition 23). In various embodiments, any of Liquid Additive Compositions 20-23 can further comprise up to 1% by weight, and preferably from at least 0.05% by weight and up to 0.8% by weight, of an inorganic fluoride salt selected from the group consisting of: calcium fluoride; lithium fluoride; magnesium fluoride; and any combination thereof, wherein the inorganic fluoride salt is preferably calcium fluoride (Liquid Additive Composition 24). In further embodiments, the inorganic fluoride salt is solubilized within a mixture of one or more oil-soluble weak organic acids and one or more oil-soluble strong organic acids, forming an inorganic fluoride salt composition, wherein the inorganic fluoride salt composition comprises up to 10% by weight, preferably from at least 0.5% and up to 8% by weight of the additive composition, wherein the one or more oil-soluble weak organic acids are selected from the group consisting of: an alkyl carboxylic acid; an aryl carboxylic acid; any Lewis acid having a pKa greater than 4.0; and any combination thereof, and wherein the one or more oil-soluble strong acids are selected from the group consisting of: an alkyl sulfonate; an aryl sulfonate; any phosphate acid having a pKa lower than 4.0; and any combination thereof (Liquid Additive Composition 25). In various embodiments, any of Liquid Additive Compositions 20-25 can further comprise up to about 15% by weight of a polymeric dispersant, the polymeric dispersant comprising one or more oil-soluble copolymers of olefins having a polymeric amine core (Liquid Additive Composition 26). In various embodiments, any of Liquid Additive Compositions 20-26 can further comprise up to 50% by weight of a viscosity modifier, the viscosity modifier preferably selected from the group consisting of: a mixture of one or more medium-to high-molecular weight olefin copolymers; and a mixture of one or more polymethacrylate copolymers of a methacrylic acid esters (Liquid Additive Composition 27). In various embodiments, any of Liquid Additive Compositions 20-27 can further comprise up to 10% by weight of a colorant, preferably an oil-soluble dye (Liquid Additive Composition 28). In various embodiments, any of Liquid Additive Compositions 20-28 can be produced as a homogeneous composition having no visible suspended or settled particles. In various embodiments, any of Liquid Additive Compositions 20-28 can be added to a base oil selected from the group consisting of a gear oil; an engine oil; a hydraulic pump oil; a bearing oil; a way oil; a transmission or clutch fluid; an agricultural or construction equipment oil; and a mining, mill, or rock crusher oil.

According to the present invention, any of the lubricant or additive compositions described herein and above can be produced as stable, homogeneous compositions with no visible suspended or settled particles. In various embodiments, the compositions are translucent. In some embodiments, any of the compositions described herein and above can be maintained for at least 1 week, 2 weeks, 1 month, 2 months, 3 months, 6 months, 9 months, or 1 year without visible particle formation and settling. In some embodiments, any of the lubricant compositions described herein and above can further comprise a colorant, which can be utilized, in non-limiting examples, to assist visual inspection of the composition, indicate a source identifier, differentiate the composition from other lubricant compositions, satisfy color requirements (e.g., some regulations require automatic transmission fluid to be red), or provide enhanced aesthetic appeal to customers. In some embodiments, the colorant is an oil-soluble dye. In some embodiments, any of the lubricant compositions described herein and above can comprise up to 2% by weight of the colorant.

DETAILED DESCRIPTION OF THE INVENTION

Definitions

Unless otherwise provided, the terms listed herein have the meaning provided below.

Other than in any operating examples, or where otherwise indicated, all numbers expressing quantities of composition components, reaction conditions, and the like that are used in the specification and claims are understood as being modified in all instances by the term, "about." Accordingly, the term "about" is used to describe approximations of numerical parameters set forth in the specification and claims that may vary depending upon the desired properties to be obtained by the present invention. At the very least, and not an attempt to limit the application of the doctrine of equivalents to the scope of the claims, each numerical parameter should at least be construed relative to the number of reported significant digits and by applying ordinary rounding techniques.

The terms "acid value" and "acid number" are interchangeably used to describe the amount of carboxylic acid groups present within an inorganic fluoride salt composition to solubilize an inorganic fluoride salt, and are typically expressed as milligrams of potassium hydroxide required to titrate a 1-gram sample to a specified endpoint. Methods for determining acid values are well-known in the art, and are defined, for example, according to ISO 2114-2000 and ASTM D974-04 ("Standard Test Method for Acid and Base Number by Color-Indicator Titration").

The terms "hydroxyl number", "hydroxyl value", "base value", and "base number" are all interchangeably used to describe the ability of a lubricant or additive composition to neutralize acids formed during engine operation, are typically expressed as milligrams of potassium hydroxide required to titrate a 1-gram sample to a specified endpoint. In some embodiments, the base number can be adjusted upon the addition of a polymeric dispersant and/or viscosity modifier to the composition. Methods for determining base values are well-known in the art, and are defined, for example, according to ISO 4629-1978 and ASTM D1957-86 ("Standard Test Method for Hydroxyl Value of Fatty Oils and Acids"), or ISO 2114-2000 and ASTM D974-04 ("Standard Test Method for Acid and Base Number by Color-Indicator Titration").

The term, "group" is used to describe a chemical substituent, and includes the unsubstituted group and that group with O, N, Si, or S atoms, for example, in the chain (as in an alkoxy group) as well as carbonyl groups or other conventional substitution. As a non-limiting example, the phrase "alkyl group" is intended to include not only pure open chain saturated hydrocarbon alkyl substituents, such as methyl, ethyl, propyl, t-butyl, and the like, but also alkyl substituents bearing further substituents known in the art, such as hydroxy, alkoxy, alkylsulfonyl, halogen atoms, cyano, nitro, amino, carboxyl, etc. Thus, "alkyl group" includes ether groups, haloalkyls, nitroalkyls, carboxyalkyls, hydroxyalkyls, sulfoalkyls, etc. As used herein, the term "group" is intended to be a recitation of both a particular moiety, as well as a recitation of the broader class of substituted and unsubstituted structures that includes the moiety.

The term, "moiety" is used to describe a chemical compound or substituent, only an unsubstituted chemical material is intended to be included. As a non-limiting example, the phrase "alkyl moiety" can be limited to the inclusion of only pure open chain saturated hydrocarbon alkyl substituents, such as methyl, ethyl, propyl, t-butyl, and the like.

The term "number average molecular weight" ($M_n$) is used to describe a method of reporting the average molecular weight of polymers in a mixture, calculated by dividing the total weight of all of the polymers in the sample divided by the number of polymers in a sample, using the equation, $$\overline{M}_N = \frac{\sum_i N_i M_i}{\sum_i N_i},$$

wherein $N_i$ is the number of polymers of molecular mass $M_i$.

The term "polymer" includes both homopolymers and copolymers (i.e., polymers of two or more different monomers). Similarly, unless otherwise indicated, the use of a term designating a polymer class such as, for example, "polyester" is intended to include both homopolymers and copolymers (e.g., polyester-urethane polymers).

The terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

The term "wear scar" refers to a metric used to determine the quality of oils and their lubricity, based on evaluating the anti-wear properties of fluid lubricants in sliding contact. Methods for evaluating the anti-wear properties by measuring wear scar diameters are well-known in the art. As a non-limiting example, the wear properties of lubricating oils and greases can be determined according to the ASTM D2255 or D4172 four-ball wear test methods, in which three steel balls are clamped together and covered with a lubricant oil or grease, and a fourth steel ball is pressed into the other steel balls at a selected force. After some time, the wear scars on the steel balls are measured, typically on a millimeter scale, and average wear scars can be compared across multiple lubricant formulations. As another non-limiting example, the wear properties of lubricating oils and greases under extreme pressure conditions can be determined according to the ASTM D2596 or D2783 extreme pressure (EP) four-ball wear test methods, which are measured similarly to ASTM D2255 or D4172 four-ball wear test methods but under higher force loads.

The term, "load wear index" (LWI) refers to a weighted average of wear scars measured for force loads prior to welding, in which higher values indicate increased extreme-pressure lubricant performance.

The term "coefficient of friction" refers to a dimensionless number that is defined as the ratio between friction force and normal force. Generally, compositions having a lower coefficient of friction relative to others are considered more lubricious, and in some embodiments, compositions of the present invention can have coefficient-of-friction (COF) values less than 0.3, 0.25, 0.2, 0.15, or 0.1, down to less 0.05. Methods for determining a composition's COF are well-known in the art. As a non-limiting example, ASTM D1894-14 is a widely-used method for COF measurement. However, and in some embodiments, equipment used to evaluate in ASTM methods D2255, D2596, D2783, or D4172 can also be adapted to measure the COF as well as wear-scar diameter.

In describing features herein as pertaining to "any of the various embodiments" or "in various embodiments", the described feature should be understood to be capable of being combined with any other features and embodiments described within the description, unless such combination or use would be clearly unreasonable or contradict the usefulness or purpose of the described feature.

As used herein, "a," "an," "the," "at least one," and "one or more" are used interchangeably. Thus, for example, a coating composition that comprises "an" additive can be interpreted to mean that the coating composition includes "one or more" additives.

Also herein, the recitations of numerical ranges by endpoints include all numbers subsumed within that range (e.g., 1 to 5 includes 1, 1.5, 2, 2.75, 3, 3.80, 4, 5, etc.). Furthermore, disclosure of a range includes disclosure of all subranges included within the broader range (e.g., 1 to 5 discloses 1 to 4, 1.5 to 4.5, 1 to 2, etc.). It will be understood that the total sum of any quantities expressed herein as percentages cannot (allowing for rounding errors) exceed 100%.

Exemplary Embodiments of the Present Invention

The compositions of the invention are formulated to provide increased protection over present lubricants, oils, and greases, particularly when operating under high-performance, high-temperature, and/or extreme-pressure conditions. In particular, the compositions are formulated to prevent the "fallout" of dispersed insoluble particles that is common in many lubricant formulations, such as those described in U.S. Pat. No. 9,206,377, which is herein incorporated by reference in its entirety. In some embodiments, the compositions can comprise all liquid, liquefacted, and/or sub-micronized components, such that where particles are present, they remain dispersed homogeneously throughout the composition with no fallout. Without being limited by a particular theory, it is believed that the sub-micronizing, liquefacting, and/or liquifying otherwise insoluble components, particularly molybdenum-containing components, the color of the composition can be controlled and maintained for extended periods of time, either in storage or on the lubricated surface itself.

The following working and prophetic examples illustrate the embodiments of the invention that are presently best known. However, it is to be understood that the following are only exemplary or illustrative of the application of the principles of the present invention. Numerous modifications and alternative compositions, methods, and systems may be devised by those skilled in the art without departing from the spirit and scope of the present invention. Thus, while the present invention has been described above with particularity, the following examples provide further details in connection with both practical and preferred embodiments of the invention.

Product Formulation

Several of the lubricant and additive compositions indicated in the examples below were prepared according to the following procedure. Without being limited by a particular theory, it is believed that a person of ordinary skill in the art could prepare compositions within any of the prophetic examples below using the same procedure, or a similar procedure modified without undue experimentation.

Lubricant compositions of the present invention were prepared by adding each of the individual components to a base oil in a mixing kettle with constant mixing. Components were typically added in order from components having the highest viscosity to the lowest viscosity. Each component was stirred for fifteen to twenty minutes to ensure full mixing, prior to adding the next component. Mixing generally was performed at 60° C., but can alternatively be performed at 40° C. or ambient temperature. Once all components have been added, composition are cooled to ambient temperature, prior to filtering and packaging into a drum, tote, bottle, bulk tanker, or other receptacle.

Additive compositions of the present invention can be prepared similarly to the lubricant compositions regarding order of addition, mixing time, mixing speed, and/or cooling steps.

Composition Components

Generally, each of the components listed and described below are commercially available and can directly be added and mixed into any of the compositions described herein without having to be chemically or physically modified. However, instances where a commercially-obtained product is modified prior to formulation are indicated.

Inorganic Lubricants

Transition metal compounds such as molybdenum disulfide, tungsten carbide, and tungsten disulfide, as well as other inorganic compounds such as boron nitride and graphite, are commonly-known additives for reducing friction. Each of the compounds is most commonly available with mean particle sizes of about one to thirty microns, which makes them well-suited for dispersion within a liquid carrier when formulating lubricant compositions. Of the inorganic compounds above, molybdenum disulfide is often selected because of its cost, availability, high operating temperature capability and overall long-term performance. A non-limiting example of commercially-available molybdenum disulfide is Bonderite® S-AD 1286 Acheson solid lubricant additive (also known as SLA 1286), sold by Henkel Corporation.

In many instances, molybdenum disulfide is provided as a mixture with graphite, where the ratio of molybdenum disulfide to graphite is in a range from about 3:7, up to about 7:3. A non-limiting example of commercially-available micron-sized graphite is Bonderite® L-GP OILDAG®. However, as described above, compositions containing inorganic compounds in solid form are prone to fallout, wherein over time, the compositions can separate into multiple layers which either require additional processing to re-disperse the particles into a liquid layer, or cannot be recovered at all.

Therefore, and in some embodiments, organic molybdenum can be utilized within any of the compositions described herein as a substitute for molybdenum disulfide. Typical organic molybdenum are Molybdenum dithiocarbamates (MoDTC), molybdenum dialkyl dithiophosphate (MoDTP), molybdenum dialkyldithiophosphate (MoDDP) and molybdenum amide. Without being limited by a particular theory, it is believed that the tribo-chemical decomposition of organic molybdenum can generate molybdenum disulfide in situ, reducing the coefficient of friction between the two or more surfaces.

Advantageously, many organic molybdenum compounds, including MoDTC, MoDTP, MoDDP and molybdenum amide are soluble on oil, and can be included in a lubricant or additive composition without exhibiting fallout. Additional discussion of organic molybdenum can be found, for example, in Wang, W, et al., (2021) "Tribological performance of organic molybdenum in the presence of organic modifier" *PLoS ONE* 16(6):e0252203, the disclosure of which is herein incorporated by reference in its entirety. One non-limiting example of a commercially-available organic molybdenum is Molyvan® 3000, which is a MoDTC friction reducer that is soluble at low- or ambient temperatures in a variety of base oils, including passenger motor oils, greases, industrial oils, and heavy-duty diesel engine oil, and is available from Vanderbilt Chemicals.

Nonetheless, and in other embodiments, micron-scale inorganic compounds can also be utilized in any of the lubricant or additive compositions described herein, upon physically processing the compounds until they have sub-micron particle sizes, particularly below 100 nm. One non-limiting example of a process for sub-micronizing inorganic compounds is mechanical exfoliation. In some embodiments, any one or more of tungsten disulfide, tungsten carbide, molybdenum disulfide, boron nitride, and graphite can be mechanically exfoliated by using a ball mill or similar apparatus to apply a mechanical shear to the particles, which are then combined into a composition by suspending them in a carrier in liquid phase, solid phase, or a mixture of solid and liquid phases. Non-limiting examples of liquid carriers are aqueous suspensions, organic solvents, organic liquids, oils, molten polymers, silicones, molten salts, and other low-melting point systems. Non-limiting examples of solid carriers are powders comprising organic compounds, polymer powders, or pellets below their glass transition temperature, at the glass transition temperature, and/or above the glass transition temperature, and inorganic powders such as ceramic and glass powders, metals, etc.

In various embodiments, sub-micronized inorganic compounds can be liquefacted into a liquid phase or a liquid-like phase that behaves like a fluid. One non-limiting example for liquefacting sub-micronized particles is chemical exfoliation, in which the particles are dispersed directly within a solvent, to facilitate later reconstitution as a film with one or more additional materials to form hybrids or composites useful in the electronics and energy industries (see, e.g., Coleman, J. N., et al., (2011) *Science* 331:568-571, the disclosure of which is herein incorporated by reference in its entirety). Particularly, the authors reported that sonication of boron nitride within isopropyl alcohol formed a solution that was translucent and stable for several hundred hours, with less than 20% of the boron nitride precipitating out of solution after one week.

In contrast, and in various embodiments, combination of liquefacted boron nitride with one or more additional liquid components described below can result in a stable lubricant composition having no suspended or settled particles, that can be utilized and/or stored for non-limiting exemplary periods of up to 1 month, 3 months, 6 months, 9 months, 1 year, 2 years, or 5 years with no fallout. In a further embodiment, lubricant compositions containing liquefacted boron nitride can be stored indefinitely with no particle fallout.

More details regarding mechanical exfoliation, as well as chemical exfoliation, are described in U.S. Patent Pub. No. 2016/0325994, the disclosure of which is herein incorporated by reference in its entirety.

Boron nitride can be obtained commercially in an already liquid-exfoliated form, a non-limiting example of which is Functional Ceramax Fluid, sold by Functional Products Inc, and which is provided within a mixture of aromatic hydrocarbons and esters at a boron nitride concentration of about 25% by weight. A non-limiting example of a micron-sized boron nitride that can be further exfoliated to form sub-micronized or liquefacted boron nitride is Bonderite® S-AD 1720™. In some embodiments, exfoliated boron nitride can be prepared as a liquid within any mixture of synthetic or petroleum hydrocarbons and dispersants. Such boron nitride-containing compositions are generally clear, low color, and stable.

Molybdenum Activator

In some embodiments, a molybdenum activator can be used in combination with organic molybdenum to enhance the extreme-pressure loading characteristics and achieve comparable extreme-pressure performance to molybdenum disulfide while retaining the excellent wear and friction reduction of organic molybdenum. In some embodiments, a molybdenum activator is a specific and balanced blend of two to four components from different families of sulfurized lubricant additives: sulfurized methyl esters, fats, or olefins; alkyl derivatives of dithiocarbamate, dithiophosphate; and/or alkyl dimercaptothiadiazole. A non-limiting example of a commercially-available molybdenum activator is Functional EP-203, sold by Functional Products Inc. Other commercially-available brands include Lanxess Additin RC 2400 and 2500 series, Dover EP portfolio, Seqens Sulfad portfolio, and Dailube GS and IS series.

Surface Treatment Mixture

In some embodiments, a surface treatment mixture can be added to the composition to improve metal surface characteristics by creating a stable, chemical corrosion-controlled boundary film. In some embodiments, the surface treatment mixture can comprise one or more petroleum distillates, which can be obtained by treating petroleum fractions with hydrogen to form a variety of low- or no-sulfur saturated hydrocarbon products. Depending on the reaction conditions (temperature, pressure, catalyst activity) and weight fraction of the starting material, a wide variety of short-, medium- and long-chain paraffinic distillates can be generated, including n-alkanes, isoalkanes, and naphthenes. Typically, the paraffinic distillates are produced as complex mixtures containing thousands of homologs and isomers. In some embodiments, paraffinic distillate products can be processed further in the presence of chloring gas under UV light to form chlorinated paraffinic distillates, which may further enhance the metal surface characteristics. Two non-limiting examples of commercially-available surface treatment mixtures comprising hydrotreated paraffinic and/or naphthenic petroleum distillates are Muscle Hybrid Engine Treatment™ and Metal Treatment MT-10®, both of which are sold by Muscle Products Corp.

Inorganic Salt Solubilizer

Many inorganic salts, examples of which include but are not limited to inorganic sodium, calcium, and lithium salts, are insoluble in oil-based systems. As described above, such salts, particularly inorganic fluoride salts, can be solubilized in specially-designed solubilizing compositions. Without being limited by a particular theory, it is believed that the reaction of the inorganic salt is promoted by the combination of a catalyst, heating, and mixing for a prescribed amount of time. The resulting dispersion can then be added directly into the lubricant or additive composition production batch, and can remained dispersed and stable once diluted.

One non-limiting example of an inorganic salt solubilizer is Functional SD-38, sold by Functional Products Inc., and which contains a synergistic mixture of at least one 'weak' oil-soluble organic acid and one 'strong' oil-soluble organic acid to form an inorganic salt composition. Non-limiting examples of suitable weak organic acids are alkyl or aryl carboxylic acids, boric acid, and Lewis acids with pKa>4. Non-limiting examples of suitable strong organic acids are alkyl or aryl sulfonates, phosphates with pKa<4.

To form the inorganic fluoride salt compositions indicated below, 8.5 parts by weight of the Functional SD-38 were combined with one part calcium fluoride and 0.5 parts of water. The batch was heated to 60° C. and mixed for four hours, as needed, until a color change to yellow, tan, or orange indicated that the solubilization was complete.

Polymeric Dispersant

Polymeric dispersants utilized in the production of the compositions in the examples below were composed of oil soluble copolymers of olefins (ethylene, propylene, butylene, etc.) with a polymeric amine core. This material is typical of ashless engine oil dispersants. Where present, the polymeric dispersant was used to adjust the total base number (TBN) of the finished lubricant as needed for the application, typically to meet regulatory guidelines. However, without being limited by a particular theory, it is believed that some polymeric dispersants are multi-functional additives and can provide other key benefits like corrosion inhibition, sludge/varnish control, and metal passivation. A non-limiting example of a commercially-available polymeric dispersant is Functional SD-55, which is sold by Functional Products Inc., and comprises an oil-soluble succinimide polyamine dispersant in a polyalphaolefin synthetic base fluid that is compatible with detergents, rust inhibitors, paraffin oils, and other typical industrial lubricant additives.

Viscosity Modifier

Viscosity index modifiers may be used to control the final viscosity of a lubricant formulation in several applications, non-limiting examples of which include multi-grade engine oils, industrial fluids, crankcase additives. Some viscosity modifiers can be formulated to offer high thickening efficiency, shear stability, demulsibility, and pour point depressancy. Non-limiting examples of commercially-available polymeric dispersants are Functional V-159 and Functional MH-2000, both of which are sold by Functional Products Inc.

Unless otherwise indicated, the following components were utilized in the examples below: the liquid molybdenum complex was Molyvan® 3000; the boron nitride was Functional Ceramax Fluid, in which liquefacted boron nitride within a mixture of aromatic hydrocarbons and esters at a boron nitride concentration of about 25% by weight; the molybdenum activator was Functional EP-203; the surface treatment mixture was Muscle Hybrid Engine Treatment™; the liquid calcium fluoride was calcium fluoride solubilized within Functional SD-38; the polymeric dispersant was Functional SD-55, and the viscosity modifier was either Functional V-159 or Functional MH-2000. Additionally, the concentration values of each of the compositions below are given as percent by weight, unless indicated otherwise.

Example 1: Preliminary Optimization for Automotive Gear Oils

Several compositions were generated to optimize coefficient of friction (COF), wear scar size, and load wear index. Preliminary work began with top treating a conventional 75W-90 oil with liquid molybdenum complex and molybdenum activator to produce high extreme pressure loads (Table 1). The baseline for the conventional 75W-90 with the surface treatment mixture was 500 kgf weld load with 3.88 mm scar and 0.497 COF at 400 kgf on ASTM D2783 4-ball extreme pressure test. Formula A3 and its specific ratio of liquid molybdenum complex and molybdenum activator were the best in terms of relatively low COF.

TABLE 1

| Formula | A0 | A1 | A2 | A3 | A4 | A5 | A6 | A7 |
|---|---|---|---|---|---|---|---|---|
| 75W-90 Conventional Base | | | | Balance | | | | |
| Surface Treatment Mixture | 6.0 | 6.0 | 6.0 | 6.0 | 6.0 | 6.0 | 6.0 | 6.0 |
| Liquid Molybdenum Complex | 0.0 | 4.0 | 3.0 | 2.0 | 1.0 | 2.0 | 2.0 | 0.0 |
| Molybdenum Activator | 0.0 | 3.0 | 3.0 | 3.0 | 3.0 | 4.0 | 2.0 | 4.0 |
| ASTM D2783, 620 kg | | | | | | | | |
| Wear Scar, mm | WELD | WELD | 2.9 | 3.0 | 3.5 | 3.1 | 3.0 | WELD |
| Coefficient of Friction | >0.35 | >0.35 | >0.35 | 0.32 | >0.35 | >0.35 | >0.35 | >0.35 |

Preliminary work on determining the ratio of boron nitride and calcium fluoride indicated 0.5 wt % was an optimal concentration of boron nitride (Table 2).

TABLE 2

| Formula | A3 | B1 | B2 | B3 | B4 |
|---|---|---|---|---|---|
| 75W-90 Conventional Base | | | | | |
| Surface Treatment Mixture | 6.0 | 6.0 | 6.0 | 6.0 | 6.0 |
| Liquid Molybdenum Complex | 2.0 | 2.0 | 2.0 | 2.0 | 2.0 |
| Molybdenum Activator | 3.0 | 3.0 | 3.0 | 3.0 | 3.0 |
| Boron Nitride | 0.0 | 0.125 | 0.25 | 0.5 | 0.75 |
| Liquid Calcium Fluoride | 0.0 | 0.0 | 0.0 | 0.0 | 0.0 |
| ASTM D2783, 620 kg | | | | | |
| Wear Scar, mm | 3.0 | WELD | 3.6 | 2.9 | 3.0 |
| Coefficient of Friction | 0.32 | >0.35 | 0.095 | 0.088 | >0.3 |

As illustrated in Table 3, 0.5 wt % liquid calcium fluoride to 0.5 wt % boron nitride was found to be best ratio for wear. Lesser amounts of calcium fluoride (0.125-0.25 wt %) were antagonistic to wear scar performance. In both Table 2 and Table 3, it is shown that <1% of the boron nitride or calcium fluoride can have drastic effects on extreme-pressure properties. Without being limited by a particular theory, it is believed that the utility of these additives may not obvious as it would be very easy for formulators to undertreat and see negative effects on performance. Formula C3 was found to be the best optimization of boron nitride and calcium fluoride for the given 75W-90 conventional base formula and molybdenum complex/activator top treat.

TABLE 3

| Formula | B3 | C1 | C2 | C3 |
|---|---|---|---|---|
| 75W-90 Conventional Base | | | | |
| Surface Treatment Mixture | 6.0 | 6.0 | 6.0 | 6.0 |
| Liquid Molybdenum Complex | 2.0 | 2.0 | 2.0 | 2.0 |
| Molybdenum Activator | 3.0 | 3.0 | 3.0 | 3.0 |
| Boron Nitride | 0.5 | 0.5 | 0.5 | 0.5 |
| Liquid Calcium Fluoride | 0.0 | 0.125 | 0.25 | 0.5 |
| ASTM D2783, 620 kg | | | | |
| Wear Scar, mm | 2.9 | WELD | 3.6 | 2.0 |
| Coefficient of Friction | 0.088 | >0.3 | >0.3 | >0.3 |

As shown above in Table 3, the wear scar decreased in Formula C3 relative to B3, even though the COF itself increased. Without being limited by a particular theory, it is believed that an increased COF and a smaller wear scar may be an advantage in applications such as in railway lubricants, where the COF provides traction to move the train, and is more favorable for power transmission. It is also believed that a lower COF and larger wear scar can be advantageous when lubricating smaller equipment that can overheat easily, such as a saw, or when startup torque is required in heavily loaded gears in order to reduce the energy required to get the system moving.

Example 2: Formula Optimization for Heavy-Synthetic Gear Oils

Several compositions were generated to determine whether a different gear oil base formula (SAE 250) may affect the optimal ratio of the molybdenum complex and the molybdenum activator relative to each other.

As illustrated below in Table 4, when top treating an SAE 250 synthetic product, the optimal ratio of the liquid molybdenum complex to molybdenum activator was approximately 1:1. To optimize the COF under EP conditions it became important to also consider the scarring at 620 kg but also a lower value. 400 kgf was selected because that value is equivalent to the typical failure point of standard automotive gear oils, enabling optimization beyond wear other gear oils typically fail.

TABLE 4

| Formula | A0 | A1 | A2 | A3 | A4 | A5 | A6 | A7 |
|---|---|---|---|---|---|---|---|---|
| SAE 250 synthetic base | | | | | balance | | | |
| Surface Treatment Mixture | 6.0 | 6.0 | 6.0 | 6.0 | 6.0 | 6.0 | 6.0 | 6.0 |
| Liquid Molybdenum Complex | 0.0 | 2.0 | 3.9 | 6.0 | 2.0 | 3.9 | 3.9 | 6.0 |
| Molybdenum Activator | 0.0 | 0.0 | 0.0 | 0.0 | 2.5 | 2.5 | 3.0 | 2.5 |
| Boron Nitride | 0.5 | 0.5 | 0.5 | 0.5 | 0.5 | 0.5 | 0.5 | 0.5 |
| Liquid Calcium Fluoride | 0.5 | 0.5 | 0.5 | 0.5 | 0.5 | 0.5 | 0.5 | 0.5 |
| Weld Load, ASTM D2783 | 315 | 315 | 315 | 315 | 620 | 620 | 800 | 620 |
| Wear Scar, mm @ 400 kgf | n/a | n/a | n/a | n/a | 0.0859 | 0.0819 | 0.0733 | 0.0874 |
| COF @ 400 kgf | n/a | n/a | n/a | n/a | 1.114 | 1.023 | 0.940 | 1.142 |

As indicated in Table 4 above, Formula A6 produced the highest extreme-pressure weld load with the lowest COF and wear at lower extreme-pressure loading. Accordingly, not only can weld load and peak extreme-pressure be optimized, but the friction and wear at lower pressure-load levels can also be optimized to ensure performance across a wide range of extreme-pressure conditions.

Example 3: Optimization of Component Addition

Several compositions were generated to determine whether adding the surface treatment mixture last, instead of first, may be a key factor in allowing the liquid ceramic chemistry enough time to properly activate before metal-metal contact can begin. The relative concentrations of liquid molybdenum complex, molybdenum activator, boron nitride, and liquid calcium fluoride were optimized first (Tables 5-7, below).

Formula B2 produced good ASTM D4172 wear scars and great ASTM D2783 EP performance. However, COF at lower wear levels like 200 kgf were increased while COF at very high EP loads 400+ were low, producing a skewed, bell curve-like performance profile (Table 7).

TABLE 7

| | Wear Scar, mm | COF |
|---|---|---|
| ASTM D4172 @ 15 kg | 0.304 | 0.0561 |
| ASTM D4172 @ 40 kg | 0.441 | 0.0693 |
| ASTM D2783 EP @ 200 kg | 0.984 | 0.146 |
| ASTM D2783 EP @ 400 kg | 1.06 | 0.0856 |
| ASTM D2783 EP @ 620 kg | 3.08 | 0.0868 |
| ASTM D2783 EP @ 800 kg | WELD | >0.35 |

TABLE 5

| | A1 | A2 | A3 | A4 | A5 | A6 | A7 | A8 |
|---|---|---|---|---|---|---|---|---|
| 75W-90 Synthetic Gear Oil Base | | | | | balance | | | |
| Liquid Molybdenum Complex | 2.0 | 2.4 | 2.8 | 2.5 | 3.5 | 3.35 | 2.0 | 2.3 |
| Molybdenum Activator | 3.0 | 3.6 | 4.2 | 2.5 | 3.5 | 3.35 | 4.0 | 4.7 |
| Boron Nitride | 0.5 | 0.5 | 0.5 | 0.5 | 0.5 | 0.5 | 0.5 | 0.5 |
| Liquid Calcium Fluoride | 0.25 | 0.25 | 0.25 | 0.25 | 0.25 | 0.25 | 0.25 | 0.25 |
| ASTM D2783, 4-ball EP | | | | | | | | |
| Wear Scar @ 400 kgf | 1.75 | 1.58 | 1.46 | 1.73 | 1.48 | | 1.46 | |
| COF @ 400 kgf | 0.0893 | 0.0882 | 0.0841 | 0.0943 | 0.0815 | | 0.0863 | |
| Wear Scar @ 620 kg | | | | | 3.1 | >4.0 | 1.8 | 2.0 |
| COF @ 620 kg | | | | | 0.0862 | >0.35 | 0.0643 | 0.0685 |

Beginning from A7, the levels were boron and fluoride were checked and adjusted for optimal ratio (Table 6). A 1:1 ratio was again found to be most favorable for balancing extreme-pressure wear and COF in Formula B2.

1-8% Surface Treatment Mixture was added to Formula B3, and the wear scar and coefficient of friction were evaluated under 200 kg load (Table 8).

TABLE 6

| | A7 | B1 | B2 | B3 | B4 |
|---|---|---|---|---|---|
| 75W-90 Synthetic Gear Oil Base | | | balance | | |
| Liquid Molybdenum Complex | 2.0 | 2.0 | 2.0 | 2.0 | 2.0 |
| Molybdenum Activator | 4.0 | 4.0 | 4.0 | 4.0 | 4.0 |
| Boron Nitride | 0.5 | 0.25 | 0.5 | 0.5 | 0.75 |
| Liquid Calcium Fluoride | 0.25 | 0.13 | 0.5 | 0.75 | 0.38 |
| ASTM D2783, 4-ball EP | | | | | |
| Wear Scar @ 400 kgf | 1.46 | 1.48 | 1.25 | | 1.46 |
| COF @, 400 kgf | 0.0863 | 0.08726 | 0.0808 | | 0.0819 |
| Wear Scar @ 620 kg | 1.8 | WELD | 1.6 | 2.1 | 1.94 |
| COF @ 620 kg | 0.0643 | >0.35 | 0.0649 | 0.0661 | 0.0685 |

TABLE 8

| Surface Treatment Mixture (w/w) | Wear Scar @ 200 kg | COF 200 kg |
|---|---|---|
| 0% | 0.984 | 0.146 |
| 1% | 1.001 | 0.157 |
| 2% | 0.987 | 0.161 |
| 4% | 0.991 | 0.166 |
| 6% | 0.961 | 0.156 |
| 8% | 0.913 | 0.157 |

It was determined that adding the surface treatment mixture last had little effect on the extreme-pressure properties at a relatively low 200 kgf extreme-pressure load. 6 wt % was found to be optimal if any surface treatment mixture were to be added which improved the 40 kgf ASTM D4172 wear scar and COF to 0.393 mm and 0.0689, respectively. Without being limited by a particular theory, it is believed that though no major effects were found in ASTM D2783 EP testing, it may be preferable to include the surface treatment mixture which is active in other EP/scuffing tests like Timken OK ASTM D2782. Formula B3, with 6% surface treatment mixture included, results in an ASTM D2783 EP load vs. wear scar profile that produces a load wear index of 140 (Table 9), which is approximately two times higher than the industry leader in 75W-90 full synthetic GL-5 gear oil (~72), identified in a 2007 Amsoil Automotive Gear Oil Study.

TABLE 9

| Load, kgf | 126 | 160 | 200 | 250 | 315 | 400 | 500 | 620 |
|---|---|---|---|---|---|---|---|---|
| Wear Scar, mm | 0.396 | 0.841 | 0.961 | 0.991 | 0.989 | 1.035 | 1.142 | WELD |
| COF | 0.0656 | 0.166 | 0.156 | 0.136 | 0.111 | 0.0890 | 0.0782 | n/a |

Example 4: Optimization for 15W-40 and 10W-30 Engine Oils

Several compositions were generated to determine optimized concentration values for components within a lubricant composition in which the base oil is a 15W-40 Heavy Duty Diesel Engine Oil. Primary formulation began with the liquid molybdenum and surface treatment mixture additives at 1-5 wt % using a 2×2 grid of different treat rates (Table 10). Molybdenum activator was excluded to limit the sulfur content, which is tightly controlled by most engine-oil regulating bodies.

TABLE 10

| Components by wt % | A0 | A1 | A2 | A3 | A4 | A5 |
|---|---|---|---|---|---|---|
| 15W-40 Base Formula | 100 | 95.6 | 92.6 | 94.2 | 91.2 | 92.8 |
| Liquid Molybdenum Complex | 0.0 | 1.4 | 1.4 | 2.8 | 2.8 | 4.2 |
| Surface treatment mixture | 0.0 | 3.0 | 6.0 | 3.0 | 6.0 | 3.0 |
| ASTM D4172 Wear at 40 kg | | | | | | |
| Wear Scar Diameter, mm | 0.309 | 0.371 | 0.341 | 0.314 | 0.337 | 0.259 |
| Coefficient of Friction | 0.0862 | 0.0979 | 0.0734 | 0.0940 | 0.0994 | 0.0757 |

Formula A5 demonstrated significant anti-wear and COF improvement and served as the foundation for building the ceramic formulation. Fine adjustment was made on Formula A5 using the boron nitride and liquid calcium fluoride at a fixed total wt % of about 1-1.1% (Table 11).

TABLE 11

| Components by wt % | A5 | B1 | B2 | B3 |
|---|---|---|---|---|
| 15W-40 Base Formula | 92.8 | 91.7 | 91.7 | 91.8 |
| Liquid Molybdenum Complex | 4.2 | 4.2 | 4.2 | 4.2 |
| Surface treatment mixture | 3.0 | 3.0 | 3.0 | 3.0 |
| Boron Nitride | 0.0 | 0.2 | 0.9 | 0.5 |
| Liquid Calcium Fluoride | 0.0 | 0.9 | 0.2 | 0.5 |
| ASTM D4172 Wear at 40 kg | | | | |
| Wear Scar Diameter, mm | 0.259 | 0.285 | 0.334 | 0.291 |
| Coefficient of Friction | 0.0757 | 0.0819 | 0.1010 | 0.0685 |

Surprisingly, a different optimal ratio of boron nitride to calcium fluoride was found versus result reported in U.S. Pat. No. 9,206,377, incorporated by reference above in its entirety. A 1:1 ratio of the boron nitride to liquid calcium fluoride corresponds to an approximately 2:1 $BN/CaF_2$ ratio by weight, which is opposite the 1:2 $BN/CaF_2$ ratio preferred in U.S. Pat. No. 9,206,377. Also surprisingly, this 1:1 ratio for the boron nitride to liquid calcium fluoride is the same optimal ratio observed in Examples 1-3 above. Of the formulas in Table 11, Formula B3 was deemed best due to the lowest COF with wear below 0.30 mm.

The total base number (TBN) and kinematic viscosity of Formula B3 was adjusted using polymeric dispersant and viscosity modifier, to reestablish the original TBN and viscosity of the base 15W-40 product, illustrated by Formula C1 in Table 12, below. Without being limited by a particular theory, it is believed that the use of polymeric dispersant and viscosity modifier also provides an extra safety factor to prevent any potential long-term fallout that could occur in storage (in addition to all the additives being liquid and oil-soluble), and that the polymeric dispersant also helps neutralize any residual acids (TAN) from the liquid calcium fluoride solubilizer.

TABLE 12

| Components by wt % | B3 | C1 |
|---|---|---|
| 15W-40 Base Formula | 91.8 | 91.8 |
| Liquid Molybdenum Complex | 4.2 | 4.2 |
| Surface treatment mixture | 3.0 | 3.0 |
| Boron Nitride | 0.5 | 0.5 |
| Liquid Calcium Fluoride | 0.5 | 0.5 |
| Polymeric Dispersant | 0.0 | 4.0 |
| Viscosity Modifier | 0.0 | 2.0 |
| ASTM D4172 Wear at 40 kg | | |
| Wear Scar Diameter, mm | 0.291 | 0.258 |
| Coefficient of Friction | 0.0685 | 0.0649 |

The same combination of components was also tested to a 10W-30 passenger car oil. A comparison of the formulas with the different base oils is illustrated in Table 13, below.

TABLE 13

| Components by wt % | C1 (15W-40) | D1 (10W-30) |
|---|---|---|
| 15W-40 Base Formula | 91.7 | 0.0 |
| 10W-30 Base Formula | 0.0 | 91.7 |
| Liquid Molybdenum Complex | 4.2 | 4.2 |
| Surface treatment mixture | 3.0 | 3.0 |
| Boron Nitride | 0.5 | 0.5 |
| Liquid Calcium Fluoride | 0.5 | 0.5 |
| Polymeric Dispersant | 4.0 | 4.0 |
| Viscosity Modifier | 2.0 | 2.0 |
| ASTM D4172 Wear at 40 kg | | |
| Wear Scar Diameter, mm | 0.258 | 0.270 |
| Coefficient of Friction | 0.0649 | 0.0755 |

As shown in Table 13, Formula C1 and Formula DI exhibit very similar wear scar diameter and COG results, within the apparent batch-to-batch variation. Without being limited by a particular theory, it is believed that for engine oils, the combination of components appears to act independently of the natural components of the 10W-30 and 15W-40 base oils, and the apparently optimized 1:1 ratio for the boron nitride to liquid calcium fluoride is also maintained across both engine base oils.

Example 5: Optimization for Hydraulic Oils

Without being limited by a particular theory, it is believed that industrial fluids like hydraulic oil have a well-known need for lower wear and friction which results in higher efficiencies in both the rate of work and fuel savings. Accordingly, a hydraulic fluid was prepared using a base ISO 46 rust and oxidation (R&O) inhibited oil (Table 14, below). Due to the lower operating temperatures and lack of extreme-pressure conditions the molybdenum activator was removed. Calcium fluoride was also excluded to evaluate the performance of only chlorine, molybdenum, and boron components.

TABLE 14

| Components by wt % | A0 | A1 | A2 | A3 | A4 | A5 | A6 | A7 |
|---|---|---|---|---|---|---|---|---|
| ISO 46 R&O oil | 100 | 99 | 98 | 97 | 97 | 95 | 97.5 | 96 |
| Liquid Molybdenum Complex | | 0.75 | 1.5 | 2.25 | 0.75 | 0.75 | 1.5 | 1.5 |
| Boron Nitride | | 0.25 | 0.5 | 0.75 | 0.25 | 0.25 | 0.5 | 0.5 |
| Surface treatment mixture | 0 | 0 | 0 | 0 | 2 | 4 | 0.5 | 2 |
| ASTM D4172, @ 40 kg | | | | | | | | |
| Wear Scar Diameter, mm | 0.468 | 0.453 | 0.372 | 0.359 | 0.376 | 0.412 | 0.287 | 0.428 |
| Coefficient of Friction | 0.0647 | 0.0575 | 0.0726 | 0.0683 | 0.0679 | 0.0736 | 0.0691 | 0.0604 |

As illustrated in Table 14, Formula A6 offers exceptional performance in terms of wear and COF reduction at <0.3 mm wear scar by ASTM D4172 at 40 kgf load. However, and without being limited by a particular theory, it is believed that any formulation with <0.4 mm wear could potentially be a candidate for further development with hydraulic fluid base oils.

Further investigation was made into balancing the ratio of liquid molybdenum complex to boron nitride at a fixed 1 wt % (Table 15, below). Without being limited by a particular theory, it is believed that Formula B3 exhibited an ideal ratio of 3:1 liquid molybdenum complex to boron nitride for greatly reducing friction. Wear scar diameter appeared to exhibit two regimes of behavior with moderate wear scar diameters (<0.5 mm) at >0.5 wt % liquid molybdenum and high wear scar diameters (>0.5 mm) at <0.5 wt % liquid molybdenum.

TABLE 15

| Components by wt % | B0 | B1 | B2 | B3 | B4 | B5 | B6 | B7 |
|---|---|---|---|---|---|---|---|---|
| ISO 46 R&O Oil | 100 | 99 | 99 | 99 | 99 | 99 | 99 | 99 |
| Liquid Molybdenum Complex | | 1.0 | 0.875 | 0.75 | 0.6 | 0.5 | 0.4 | 0.25 |
| Boron Nitride | | 0.0 | 0.125 | 0.25 | 0.4 | 0.5 | 0.6 | 0.75 |
| ASTM D4172, 40 kgf | | | | | | | | |
| Wear Scar Diameter, mm | 0.468 | 0.429 | 0.449 | 0.453 | 0.462 | 0.635 | 0.833 | 0.599 |
| Coefficient of Friction | 0.0647 | 0.0645 | 0.0725 | 0.0575 | 0.0876 | 0.0769 | 0.1042 | 0.0882 |

While particular embodiments of the invention have been described, the invention can be further modified within the spirit and scope of this disclosure. Those skilled in the art will recognize, or be able to ascertain using no more than routine experimentation, numerous equivalents to the specific procedures, embodiments, claims, and examples described herein. As such, such equivalents are considered to be within the scope of the invention, and this application is therefore intended to cover any variations, uses or adaptations of the invention using its general principles. Further, the invention is intended to cover such departures from the present disclosure as come within known or customary practice in the art to which this invention pertains and which fall within the appended claims.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

The contents of U.S. Patent Nos. cited in this application are hereby incorporated by reference, and shall not be construed as an admission that such reference is available as prior art to the present invention. All of the incorporated publications and patent applications in this specification are indicative of the level of ordinary skill in the art to which this invention pertains, and are incorporated to the same extent as if each individual publication or patent application was specifically indicated and individually indicated by reference.

Because the instant application is a continuation or divisional application, to the extent any amendments, characterizations, or other assertions previously made (in any related patent applications or patents, including any parent, sibling, or child) with respect to any art, prior or otherwise, could be construed as a disclaimer of any subject matter supported by the present disclosure of this application, Applicant hereby rescinds and retracts such disclaimer. Applicant also respectfully submits that any prior art previously considered in any related patent applications or patents, including any parent, sibling, or child, may need to be re-visited.

We claim:

1. A liquid composition formulated to provide enhanced lubrication and anti-wear properties under extreme pressure conditions, the composition comprising:

from about 0.25% by weight and up to about 6% by weight of one or more transition metal lubricants, the transition metal lubricants selected from the group consisting of liquefacted tungsten disulfide, liquefacted molybdenum disulfide, a liquid molybdenum complex, and any combination thereof, wherein the liquid molybdenum complex comprises an oil-soluble molybdenum salt selected from the group consisting of molybdenum alkyl dithiophosphate, molybdenum alkyl dithiocarbamate, and any combination thereof; and up to about 5% by weight of liquefacted boron nitride, the liquefacted boron nitride prepared from the solvation of exfoliated solid boron nitride within a liquid carrier, wherein the composition is homogeneous and has no visible suspended or settled particles, and wherein the balance is a base oil.

2. The composition according to claim 1, wherein the composition further comprises up to about 10% by weight of a surface treatment mixture, wherein the surface treatment mixture comprises at least one hydrogenated paraffinic or naphthenic petroleum distillate.

3. The composition according to claim 2, wherein the composition further comprises up to about 0.5% by weight of an inorganic fluoride salt.

4. The composition according to claim 3, wherein the transition metal lubricant comprises a liquid molybdenum complex.

5. The composition according to claim 4, wherein the composition further comprises up to about 10% by weight of a molybdenum activator, wherein the molybdenum activator comprises two or more sulfurized lubricant additive compounds, the two or more sulfurized lubricant additive compounds selected from the group consisting of: a sulfurized methyl ether; a sulfurized fat; a sulfurized olefin; an alkyl dithiocarbamate; an alkyl dithiophosphate; an alkyl dimercaptothiadiazole; and any combination thereof.

6. The composition according to claim 4, wherein the composition further comprises up to about 5% by weight of a polymeric dispersant, the polymeric dispersant comprising one or more oil-soluble copolymers of olefins having a polymeric amine core.

7. The composition according to claim 6, wherein the composition further comprises up to about 15% by weight of a viscosity modifier.

8. The composition according to claim 1, wherein the composition further comprises up to about 2% by weight of a colorant.

9. The composition according to claim 2, wherein the composition further comprises up to about 5% by weight of a polymeric dispersant, the polymeric dispersant comprising one or more oil-soluble copolymers of olefins having a polymeric amine core.

10. The composition according to claim 9, wherein the composition further comprises up to about 15% by weight of a viscosity modifier.

11. The composition according to claim 2, wherein the composition further comprises up to about 15% by weight of a viscosity modifier.

12. The composition according to claim 1, wherein the composition further comprises up to about 0.5% by weight of an inorganic fluoride salt.

13. The composition according to claim 1, wherein the composition further comprises up to about 5% by weight of a polymeric dispersant, the polymeric dispersant comprising one or more oil-soluble copolymers of olefins having a polymeric amine core.

14. The composition according to claim 1, wherein the composition further comprises up to about 15% by weight of a viscosity modifier.

15. The composition according to claim 4, wherein the mass ratio of the liquid molybdenum complex relative to liquefacted boron nitride is in a range from about 10:1 to about 1:10.

16. The composition according to claim 15, wherein the mass ratio of the liquid molybdenum complex relative to liquefacted boron nitride is about 3:1.

17. The composition according to claim 1, wherein the mass ratio of the one or more transition metal lubricants relative to liquefacted boron nitride is in a range from about 10:1 to about 1:10.

18. The composition according to claim 17, wherein the mass ratio of the one or more transition metal lubricants relative to liquefacted boron nitride is about 3:1.

19. A liquid composition formulated to provide enhanced lubrication and anti-wear properties under extreme pressure conditions, the composition comprising:

from about 0.25% by weight and up to about 6% by weight of a liquid molybdenum complex, wherein the liquid molybdenum complex comprises an oil-soluble molybdenum salt selected from the group consisting of molybdenum alkyl dithiophosphate, molybdenum alkyl dithiocarbamate, and any combination thereof;

up to about 10% by weight of a molybdenum activator, wherein the molybdenum activator comprises two or more sulfurized lubricant additive compounds, the two or more sulfurized lubricant additive compounds selected from the group consisting of: a sulfurized methyl ether; a sulfurized fat; a sulfurized olefin; an alkyl dithiocarbamate; an alkyl dithiophosphate; an alkyl dimercaptothiadiazole; and any combination thereof; and up to about 5% by weight of liquefacted boron nitride, the liquefacted boron nitride prepared from the solvation of exfoliated solid boron nitride within a liquid carrier, wherein the composition is homogeneous and has no visible suspended or settled particles, and wherein the balance is a base oil.

20. A liquid additive composition formulated for addition to a base oil to provide enhanced lubrication and anti-wear properties under extreme pressure conditions, the composition comprising:

up to about 90% by weight of a liquid molybdenum complex, wherein the liquid molybdenum complex comprises an oil-soluble molybdenum salt selected from the group consisting of molybdenum alkyl dithiophosphate, molybdenum alkyl dithiocarbamate, and any combination thereof; and up to about 80% by weight of liquefacted boron nitride, the liquefacted boron nitride prepared from the solvation of exfoliated solid boron nitride within a liquid carrier, wherein the composition is homogeneous and has no visible suspended or settled particles.

* * * * *